US009086670B2

(12) United States Patent
Matsuda et al.

(10) Patent No.: US 9,086,670 B2
(45) Date of Patent: Jul. 21, 2015

(54) IMAGE FORMING APPARATUS

(71) Applicant: CANON KABUSHIKI KAISHA, Tokyo (JP)

(72) Inventors: Kohei Matsuda, Fujisawa (JP); Koichiro Takashima, Fujisawa (JP); Masahiro Yoshida, Tokyo (JP); Kuniaki Tamagaki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/936,519

(22) Filed: Jul. 8, 2013

(65) Prior Publication Data

US 2014/0016952 A1 Jan. 16, 2014

(30) Foreign Application Priority Data

Jul. 10, 2012 (JP) ..... 2012-154478

(51) Int. Cl.
*G03G 21/02* (2006.01)
*G03G 15/00* (2006.01)
*G03G 21/00* (2006.01)

(52) U.S. Cl.
CPC ..... *G03G 15/75* (2013.01); *G03G 15/55* (2013.01); *G03G 15/553* (2013.01); *G03G 21/0094* (2013.01)

(58) Field of Classification Search
USPC ..... 399/26, 227–228
See application file for complete search history.

(56) References Cited

U.S. PATENT DOCUMENTS

| | | | | |
|---|---|---|---|---|
| 7,162,186 | B2 * | 1/2007 | Moritani | 399/227 |
| 7,697,879 | B2 * | 4/2010 | Watanabe et al. | 399/350 |
| 2002/0034394 | A1 | 3/2002 | Matsuguma et al. | |
| 2006/0115283 | A1 * | 6/2006 | Yamauchi et al. | 399/24 |
| 2008/0003019 | A1 * | 1/2008 | Kikuchi | 399/227 |
| 2010/0149394 | A1 | 6/2010 | Yamazaki et al. | |
| 2010/0303480 | A1 * | 12/2010 | Stuckey et al. | 399/26 |
| 2011/0063488 | A1 | 3/2011 | Nakazawa | |
| 2011/0216358 | A1 * | 9/2011 | Katou et al. | 358/1.15 |
| 2012/0195604 | A1 * | 8/2012 | Kakigi | 399/26 |

FOREIGN PATENT DOCUMENTS

| | | | |
|---|---|---|---|
| JP | 2001-356655 | A | 12/2001 |
| JP | 2003323090 | A * | 11/2003 |
| JP | 2010-147684 | A | 7/2010 |

OTHER PUBLICATIONS

U.S. Appl. No. 13/936,548, filed Aug. 7, 2013, Daisuke Kobayashi.

* cited by examiner

*Primary Examiner* — Clayton E Laballe
*Assistant Examiner* — Leon W Rhodes, Jr.
(74) *Attorney, Agent, or Firm* — Canon U.S.A., Inc. IP Division

(57) ABSTRACT

Based on a photosensitive drum life threshold value when each of the plurality of image formation execution modes is independently used, and a photosensitive drum life threshold value according to a usage rate of each of the image formation execution modes, the image forming apparatus having a plurality of image formation execution modes calculates a photosensitive drum life threshold value according to the usage rate. Then, the image forming apparatus compares the calculated photosensitive drum life threshold value with a remaining CT film thickness prediction value for the photosensitive drum to determine the life of the photosensitive drum.

14 Claims, 8 Drawing Sheets

IMAGE FORMING APPARATUS

BACKGROUND OF THE INVENTION

1. Field of the Invention

The present disclosure relates to an image forming apparatus, such as an electrophotographic copying machine and an electrophotographic printer.

An electrophotographic image forming apparatus forms an image on a recording medium (recording sheet) by using the electrophotographic image forming process. Electrophotographic image forming apparatuses include, for example, electrophotographic copying machines, electrophotographic printers (such as laser beam printers and light emitting diode (LED) printers), facsimile machines, and word processors.

2. Description of the Related Art

With the progress of the information society in recent years, the needs for color image forming apparatuses have been increasing, and increasing number of full color image forming apparatuses (such as color copying machines and color printers) for outputting color images have been put into practical use.

Such a full color image forming apparatus includes four image forming stations corresponding to four colors (yellow, magenta, cyan, and black) disposed in a row in this order. Toner images formed on photosensitive drums (image carriers) of respective image forming stations are primarily transferred onto an intermediate transfer member in sequence so that the toner images are placed on top of each other. Thus, a 4-color toner image is formed on the intermediate transfer member. Then, the 4-color toner image is secondarily transferred onto a recording medium to acquire an output image. This process is referred to as in-line process. Full color image forming apparatuses employing the in-line process are widely used.

In each image forming station, a charging device, such as a charging roller in contact with a photosensitive drum, charges the photosensitive drum. Then, an image exposure device forms an electrostatic latent image according to the image information on the photosensitive drum surface. A developing device storing toner (developer) develops the electrostatic latent image into a visible toner image of each color.

Visible toner images formed on the photosensitive drum surfaces in respective image forming stations are primarily transferred onto the intermediate transfer member in sequence so that the toner images are placed on top of each other. Thus, an unfixed 4-color (yellow, magenta, cyan, and black) full color toner image is formed on the intermediate transfer member.

The full color toner image is secondarily transferred from the intermediate transfer member onto a recording medium. Then, a fixing device heats and pressurizes the toner image to fix it to form a recorded image. After the primary transfer onto the intermediate transfer member, a cleaning unit having a cleaning blade collects primary transfer residual toner remaining on the photosensitive drum surface as waste toner. Thus, the photosensitive drum surface is cleaned, and prepares for the next image formation.

As the developing device, the contact developing method is widely used, in which a developing roller made of elastic rubber is brought into contact with the photosensitive drum to develop the electrostatic latent image on the photosensitive drum.

Each image forming station may be configured as a process cartridge which integrates any one or all of the photosensitive drum, the charging device, the developing device, and the cleaning unit, and is easily detachably attached to the image forming apparatus.

A full color image forming apparatus is provided with the full color mode in which image formation is performed by using toners of a plurality of colors to output a full color image, and the mono color mode in which image formation is performed by using only monochromatic (black) toner to output a mono color image. In the mono color mode, ideally, the photosensitive drums and developing devices for non-black colors are deactivated to avoid abrasion of these members.

In this case, however, relevant drive units will be complicated possibly resulting in an increase in size and cost of the apparatus. Therefore, in the mono color mode, the developing devices for non-black colors are separated from respective photosensitive drums and deactivated, but the photosensitive drums for all colors may be operating with the charging bias voltage applied thereto.

Further, with a process cartridge type image forming apparatus, when a consumable, such as a photosensitive drum and toner, reaches or comes close to the end of the life, it is necessary to inform a user of the relevant fact to allow the user to replace the relevant cartridge with a new one at an appropriate timing.

As a photosensitive drum, an organic photosensitive member composed of a supporting member, and a photosensitive layer (organic photosensitive layer) formed thereon is widely used because of advantages of low price and high productivity. The photosensitive layer uses organic materials as photoconductive materials (charge generating material and charge transport material). As an organic photosensitive member, a photosensitive drum formed of laminated photosensitive layers is mainly used because of advantages of high sensitivity and diversity in material design. The laminated photosensitive layers include a charge generation layer containing a charge generating material and a charge transport layer containing a charge transport material.

In many cases, various types of layers are provided between the supporting member and the photosensitive layer to coat the surface of the supporting member, improve the coating properties of the photosensitive layer, improve the adhesiveness between the supporting member and the photosensitive layer, protect the photosensitive layer from electrical damages, improve the charging properties, improve the properties of charge injection from the supporting member to the photosensitive layer, and so on.

Providing between the photosensitive layer and the supporting member a conductive layer for coating the surface of the conductive supporting member, and an intermediate layer having electrical barrier properties for preventing charge injection from the conductive layer to the photosensitive layer enables acquiring a photosensitive drum having stability in manufacturing and quality. As bonding resin for the charge transport layer of the photosensitive drum, polycarbonate resin and polyarylate resin for improving mechanical strength are widely used.

A common photosensitive drum is formed of a resistive layer, an under coat layer, a charge generation layer, and a charge transport layer sequentially laminated on the conductive supporting member by using the dipping coating method. In the above-described image formation process, the photosensitive drum is subjected to electrical and mechanical external forces, such as discharging process due to charging, sliding friction by the developing device and the intermediate transfer member, and scratching by the cleaning blade. As a result, the charge transport layer (hereinafter referred to as CT layer) abrades away and wears down with operating time of the image forming apparatus. Therefore, in many cases, the life of the photosensitive drum is determined by the amount of remaining film thickness of the CT layer (hereinafter referred to as remaining CT film thickness).

Accordingly, there have been proposed various techniques for predicting the amount of CT layer abrasion with operating time of the photosensitive drum, and determining the life of the photosensitive drum within a range in which the levels of abrasion unevenness and fogging do not decrease. Japanese Patent Application Laid-Open No. 2001-356655 discusses a technique for comparing an integrated value integrating the time of voltage application to a photosensitive drum by a charging device and the time of contact of a developing device with the photosensitive drum with predetermined life information (photosensitive drum life threshold value) to predictively determine the life of the photosensitive drum. The technique discussed in Japanese Patent Application Laid-Open No. 2001-356655 predictively determines the life of the photosensitive drum based on the remaining CT film thickness in an image forming region on the photosensitive drum.

However, with an image forming apparatus having a plurality of image formation execution modes, such as the above-described full color and mono color modes, the abrasion state of the photosensitive drum differs for each color mode. Thus, the following problem arises.

With demands for decreasing the size and cost, and simplifying the configuration of an image forming apparatus in recent years, a process cartridge attached to the image forming apparatus is demanded to decrease in size. To miniaturize the process cartridge, members included therein also need to be smaller. To reduce the size, it is also important to reduce the length of each member in the axial direction (longitudinal direction). When adopting such a configuration, both longitudinal ends of the developing roller and the charging roller in contact with the photosensitive drum are disposed at close positions on the photosensitive drum surface.

In such a configuration, the amount of abrasion of the photosensitive drum is not uniform in the longitudinal direction of the photosensitive drum. More specifically, at both longitudinal ends of the photosensitive drum, the CT layer abrasion is promoted in regions where the ends of the developing roller and the ends of the charging roller are disposed at close positions.

Specifically, a toner non-application region exists at both longitudinal ends of the developing roller. Therefore, the abrasion resulting from mechanical stress onto the photosensitive drum by the ends in the toner non-application regions of the developing roller overlap the abrasion resulting from increased amount of discharge at the end faces of the charging roller. Therefore, with the photosensitive drum, the amount of CT layer abrasion at both longitudinal ends is larger than the amount of CT layer abrasion in the image forming region used for image formation.

An increase in the amount of abrasion at both longitudinal ends of the photosensitive drum may abrade all of the charge transport (CT) layer, the charge generation layer, and the under coat layer, and the abrasion may reach the resistive layer. In this case, since the charging bias voltage applied to the developing roller and the charging roller leaks to the resistive layer, fogging may be produced due to charging failure or image may be missed due to development failure. In the above-described image formation process, this phenomenon appears more notably in the full color mode in which the developing roller is constantly in contact with the photosensitive drum.

Therefore, in the full color mode, to prevent leak at both longitudinal ends of the photosensitive drum, the time immediately before the CT layer abrasion at both longitudinal ends of the photosensitive drum reaches the resistive layer is set as the life of the photosensitive drum. The life of the photosensitive drum has been predicted by presetting as a photosensitive drum life threshold value the CT layer film thickness in the image forming region of the photosensitive drum at this timing, and performing control like discussed in Japanese Patent Application Laid-Open No. 2001-356655.

However, in this case, the CT layer film thickness in the image forming region set as the photosensitive drum life threshold value may be sufficient for performing image formation. Specifically, there has been a case where, in the image forming region of the photosensitive drum, a CT layer film thickness larger than the CT film thickness at which an image failure occurs may be set as the life of the photosensitive drum.

With the developing devices for non-black colors in the mono color mode, the developing roller is not in contact with the photosensitive drum, as described above. Therefore, at both longitudinal ends of the photosensitive drum, only the abrasion at the end faces of the charging roller affects the life. Then, with the photosensitive drums for non-black colors in the mono color mode, the CT layer abrasion, which is promoted when the ends of the developing roller and the ends of the charging roller are close to each other, does not occur at the above-described longitudinal ends.

Therefore, when printing is performed only in the mono color mode, with the photosensitive drums for non-black colors, the CT layer film thickness immediately before an image failure occurs in the image forming region can be set as the life of the photosensitive drum without being affected by the CT layer abrasion at both longitudinal ends of the photosensitive drums. In this case, of course, image formation can no longer be continued.

Therefore, with the photosensitive drums for non-black colors of the full color image forming apparatus, when image formation is performed only in the full color mode, it was necessary to set a large value of the remaining CT film thickness in the image forming region to be set as the photosensitive drum life threshold value. When image formation is performed only in the mono color mode, it is necessary to set a small value of the remaining CT film thickness in the image forming region to be set as the photosensitive drum life threshold value.

However, with the above-described conventional image forming apparatus, the remaining film thickness in the image forming region in a certain specific mode is set as the photosensitive drum life threshold value, although the image forming apparatus is provided with a plurality of modes. In all modes, the image forming apparatus predicts the life of the photosensitive drums by using the one photosensitive drum life threshold value. For this reason, there have been a case where the photosensitive drum is determined to have reached the end of the life although image formation is still possible, and a case where the photosensitive drum is continuously used although image formation is no longer possible.

SUMMARY OF THE INVENTION

An embodiment of the present invention is directed to an image forming apparatus capable of calculating a threshold value of the life of an image bearing member according to the usage rate of each color mode, and determining the life of the image bearing member based on a more suitable photosensitive layer film thickness in an image forming region of the image bearing member.

An image forming apparatus having a typical configuration for achieving the above-described object according to an embodiment of the present invention includes an image bearing member, a charging unit configured to charge the surface of the image bearing member, an electrostatic latent image forming unit configured to perform exposure of the charged surface of the image bearing member to form an electrostatic latent image on the image bearing member, a developing unit configured to develop the electrostatic latent image into a visible image by using a developer, a cleaning unit configured to clean the developer on the surface of the image bearing member, and an operating state prediction unit configured to predict an operating state of the image bearing member, wherein the image forming apparatus has a plurality of image formation execution modes having different amounts of abrasion in an image forming region of the image bearing member and different amounts of abrasion in non-image formation regions of the image bearing member, and wherein the image forming apparatus determines the life of the image bearing member based on a life threshold value of the image bearing member for each of the plurality of image formation execution modes, and a usage rate of each of the plurality of image formation execution modes.

Further features of the present invention will become apparent from the following detailed description of exemplary embodiments with reference to the attached drawings.

DESCRIPTION OF THE EMBODIMENTS

Preferable exemplary embodiments of the present invention is described with reference to the accompanying drawings. However, sizes, materials, shapes, and relative arrangements of elements described in the exemplary embodiments are not limited thereto, and should be modified as required depending on the configuration of an apparatus according to the present invention and other various conditions. The scope of the present invention is not limited to the exemplary embodiments described below.

Figure 1A:
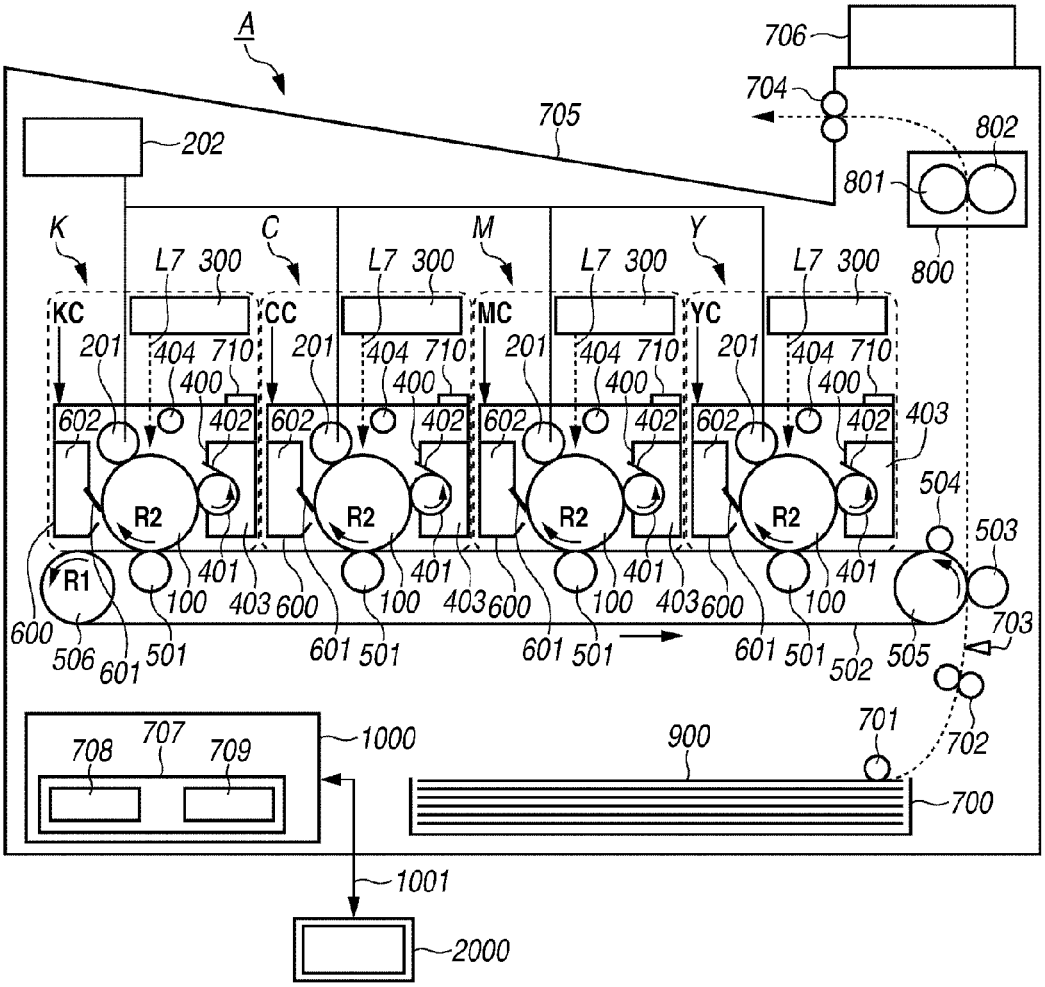
FIG. 1A schematically illustrates an image forming apparatus A according to a first exemplary embodiment.

A first exemplary embodiment of the present invention will be described below. FIG. 1A schematically illustrates an image forming apparatus A according to the first exemplary embodiment.

<Image Forming Apparatus>

The image forming apparatus A is a full color electrophotographic image forming apparatus employing the intermediate transfer in-line process. The image forming apparatus A inputs image data (electrical image information) from an external host apparatus 2000 connected to a printer control unit (central processing unit (CPU)) 1000 via an interface 1001, forms an image corresponding to the image data on a recording medium 900, and outputs an image product.

The image forming apparatus A is provided with a plurality of image formation execution modes: the full color mode in which a full color image is formed on a recording medium (hereinafter referred to as recording material) 900, and the mono color mode in which a mono color image is formed on a recording material 900.

The printer control unit (hereinafter simply referred to as control unit) 1000 totally controls operations of the image forming apparatus A, and transmits and receives various electrical information signals to/from the external host apparatus 2000 and an operation panel 706. The control unit 1000 further performs processing of electrical information signals input from various process devices and sensors, processing of command signals to various process devices, predetermined initial sequence control, and predetermined image forming sequence control. The external host apparatus 2000 is, for example, a personal computer, a network, an image reader, and a facsimile.

The image forming apparatus A includes an endless intermediate transfer belt (intermediate transfer member, hereinafter simply referred to as a belt) 502. The belt 502 is wound around a drive roller 506 and the counter roller 505 facing the drive roller 506. The drive roller 506 driven by a belt drive source (not illustrated) rotatably moves (circularly moves) the belt 502 in the direction indicated by the arrow R1.

A cleaning roller 504 for performing preprocessing for causing the photosensitive drum (rotatable image bearing members, hereinafter referred to as a drum) 100 to collect secondary transfer residual toner remaining on the belt 502 is provided at a portion of the belt 502 on the counter roller 505. A cleaning bias power supply (not illustrated) can apply a cleaning bias voltage to the cleaning roller 504.

A secondary transfer roller 503 is provided at a portion of the belt 502 on the counter roller 505. The secondary transfer roller 503 is made of an elastic material. When in pressure contact with the belt 502, the secondary transfer roller 503 forms a nip portion (secondary transfer portion) between the belt 502 and secondary transfer roller 503, and rotates with the rotation of the belt 502 and the movement of the recording material 900 sent to the nip portion.

A secondary transfer bias power supply (not illustrated) can apply a secondary transfer bias voltage to the secondary transfer roller 503. A contact and separation drive source (not illustrated) contacts and separates the secondary transfer roller 503 to/from the belt 502 at a predetermined timing so that image formation is not disturbed.

A timing roller pair 702 and a timing sensor 703 on the exit side of the timing roller pair 702 are provided below the secondary transfer roller 503. A cassette 700 storing recording materials 900 is detachably attached to the image forming apparatus A below these members. A recording material supply roller 701 pulls out recording materials 900 stored in the cassette 700 one by one at a predetermined timing, and supplies the recording material 900 to the timing roller pair 702. Plain paper, glossy paper, overhead projector sheets, etc. can be used as the recording materials 900.

The timing sensor 703 can detect that the recording material 900 has reached the position of the timing sensor 703. Based on the result of the detection, a photosensitive drum life prediction device 707 included in the control unit 1000 can count the printed-sheet number. The photosensitive drum life prediction device 707 is an operating state prediction function unit (operating state prediction unit) for predicting operating statuses of the image bearing members.

A fixing device 800 is disposed above the secondary transfer roller 503. The fixing device 800 includes a fixing roller 801 heated by a built-in halogen lamp heater (not illustrated), and a pressure roller 802 in pressure contact with the fixing roller 801. A discharge roller pair 704 and a discharge tray 705 are provided on the downstream side of the fixing device 800 in the conveyance direction of the recording material 900.

The four image forming stations are disposed above the upper portion of the belt 502 applied between the counter roller 505 and the drive roller 506. In the present exemplary embodiment, an yellow image forming station Y, a magenta image forming station M, a cyan image forming station C, and a black image forming station K are disposed in this order along the rotational direction R2 of the belt 502.

Each of the image forming stations Y, M, C, and K is provided with a photosensitive drum (hereinafter simply referred to as a drum) 100 as an image bearing member. The following various process units acting on the drum 100 are disposed around the drum 100 along the rotational direction of the drum 100.

Specifically, there is disposed a charging unit including a charging roller 201, disposed in contact with the drum 100, as a charging member for applying a voltage to the drum surface (image bearing member surface) to charge the drum surface. There is disposed an image exposure device 300 as an electrostatic latent image forming unit for exposure of the charged drum surface to form an electrostatic latent image thereon. There is disposed a developing device 400 as a developing unit for developing the electrostatic latent image into a visible toner image by using a developer applied to a developing roller 401 as a developer bearing member.

There is disposed a primary transfer roller 501 as a transfer unit for primarily transferring onto the belt 502 the toner image formed on the drum 100. There is disposed a cleaning device 600 including a cleaning blade 601, disposed in contact the drum 100, as a cleaning unit for cleaning the developer (primary transfer residual toner) on the surface of the drum 100.

In each of the image forming stations Y, M, C, and K, the drum 100, the charging roller 201, the developing device 400, and the cleaning device 600 are integrated into a process cartridge (hereinafter simply referred to as a cartridge) which is detachably attached to the image forming apparatus A. More specifically, a yellow cartridge YC constitutes the yellow image forming station Y, a magenta cartridge MC constitutes the magenta image forming station M, a cyan cartridge CC constitutes the cyan image forming station C, and a black cartridge KC constitutes the black image forming station K.

In each of the image forming stations Y, M, C, and K, the primary transfer roller 501 is disposed on the inner surface of the belt 502, and faces the bottom surface of the drum 100 via the belt 502. The primary transfer roller 501 is in contact with the bottom surface of the drum 100 via the upper portion of the belt 502, and rotatably driven by the rotation of the belt 502. In each of the image forming stations Y, M, C, and K, a contact nip portion between the drum 100 and the belt 502 is referred to as a primary transfer portion.

To primarily transfer the toner image formed on the drum 100 onto the belt 502, a primary transfer bias power supply (not illustrated) can apply a primary transfer bias voltage to the primary transfer roller 501. In the mono color mode to be described below, the control unit 1000 can select a non-collecting bias voltage of the primary transfer bias power supply not to cause the drum 100 to collect the secondary transfer residual toner remaining on the belt 502.

The drum 100 in each of the image forming stations Y, M, C, and K is a rotatable image bearing member having a photosensitive layer made of an organic material. In the present exemplary embodiment, the drum 100 is a negatively charged Φ24 drum rotatably driven by a drum drive motor (not illustrated) at the same speed as the belt 502 in the direction R2 indicated by the arrow. The drum 100 is formed of a resistive layer, a charge generation layer, an under coat layer, and a charge transport (CT) layer sequentially laminated on a conductive supporting member, such as an aluminum cylinder, by using the dipping coating method. In the first exemplary embodiment, The film thickness of the CT layer, when the drum 100 is started to be used, is set to be 13 μm.

In each of the image forming stations Y, M, C, and K, the charging roller 201 serves as a charging unit for forming an electrostatic latent image on the drum 100. The charging roller 201 in contact with the drum 100 is rotatably driven by the rotation of the drum 100. A charging bias power supply 202 applies at a predetermined timing the charging bias voltage to the drum 100 to charge the drum 100. The charging bias power supply 202 is commonly used by the four image forming stations Y, M, C, and K.

In each of the image forming stations Y, M, C, and K, the image exposure device 300 serves as an electrostatic latent image forming unit for exposure of the surface of the drum 100 (uniformly charged to predetermined polarity and potential by the charging roller 201) to form an electrostatic latent image. The image exposure device 300 according to the present exemplary embodiment is a laser scanning exposure device for outputting a laser beam L modulated according to image information input from the external host apparatus 2000 to the control unit 1000. The laser beam L scans the charged surface of the drum 100 for exposure to form an electrostatic latent image.

In each of the image forming stations Y, M, C, and K, the developing device 400 serves as a developing unit for developing the electrostatic latent image formed on the drum 100 into a visible image by using the developer applied to the developer bearing member. The developing device 400 includes the developing roller 401 as a developer bearing member, which is in contact with the drum 100 for developing the electrostatic latent image. Toner (developer) is applied to the developing roller 401. The developing device 400 further includes a developing blade 402 for restricting the toner layer thickness on the developing roller 401, and a hopper unit 403 for storing toner.

The image forming apparatus A according to the present exemplary embodiment employs negatively charged non-magnetic one-component toner as a developer. A developing bias power supply (not illustrated) applies a developing bias voltage to the developing roller 401 to reversely develop the electrostatic latent image. The developing roller 401 is formed of a silicone rubber base layer on a metal core, and a surface layer made of a resin material (urethane resin containing distributed acrylic resin beads) on the silicone rubber base layer. The hardness of the developing roller 401 is 61 degrees when measured with the ASKER RUBBER HARDNESS TESTER TYPE C, and 40 degrees when measured with the MICRO HARDNESS TESTER MD-1 (both from KOBUNSHI KEIKI CO., LTD.).

The developing device 400 further includes a swinging center 404. The developing roller 401 can contact and separate to/from the drum 100 centering on the swinging center 404 at a predetermined timing. Each of the image forming stations of the image forming apparatus A includes a development separation mechanism (developing device shift mechanism) 20 illustrated in FIG. 1B for contacting and separating the developing roller 401 to/from the drum 100.

Specifically, the development separation mechanism 20 controlled by the control unit 1000 rotates the developing device 400 in a direction toward the drum 100 centering on the swinging center 404. In this way, the development device 400 is held in a development contact state (developing position) in which the developing roller 401 is in contact with the drum 100 by a predetermined pressing force, as illustrated by the solid lines in FIG. 1B. As a result, the developing roller 401 can contact the drum 100. At the time of development contact, the developing roller 401 is rotatably driven, and the developing bias voltage is applied to the developing roller 401.

The development separation mechanism 20 rotates the developing device 400 by a predetermined amount in a direction in which the developing device 400 separates from the drum 100, centering on the swinging center 404. Thus, the developing device 400 is held in a development separation state (non-developing position) in which the developing roller 401 is separated from the drum 100 by a predetermined amount, as illustrated by the chain double-dashed lines in FIG. 1B. As a result, the developing roller 401 can be separated from the drum 100. In the development separation state, the developing roller 401 is stopped rotating, and the developing bias voltage is not applied to the developing roller 401.

In each of the image forming stations Y, M, C, and K, the cleaning device 600 serves as a cleaning unit which is in contact with the drum 100 for cleaning toner (developer) on the drum 100 (image bearing member). The cleaning device 600 according to the present exemplary embodiment is a blade cleaning unit for removing the primary transfer residual toner and paper powder on the drum 100 by using the cleaning blade 601, and collecting them into a collection container 602.

Further, the operation panel 706 is provided with a function of notifying the user of the status of the image forming apparatus A, such as information about the life of the drum 100.

<Image Forming Apparatus Operation: Full Color Mode>

First of all, operations of the image forming apparatus A in the full color mode as one image formation execution mode, in which a plurality of continuous full color output images is formed by using all of the image forming stations Y, M, C, and K, will be described.

In the standby state of the image forming apparatus A, the development separation mechanism 20 rotates the developing device 400 in each of the image forming stations Y, M, C, and K by a predetermined amount in a direction in which the developing device 400 separates from the drum 100, centering on the swinging center 404. In other words, the developing device 400 is held in a development separation state (non-developing position) in which the developing roller 401 is separated from the drum 100 by a predetermined amount, as illustrated by the chain double-dashed lines in FIG. 1B. The developing roller 401 is stopped rotating, and the developing bias voltage is not applied to the developing roller 401.

Upon reception of a print request from the external host apparatus 2000 or the operation panel 706 in the standby state of the image forming apparatus A, the control unit 1000 starts rotating the drum 100 in each of the image forming stations Y, M, C, and K. Then, the charging bias power supply 202 applies a −1000V charging bias voltage to each charging roller 201 to charge the surface of the drum 100 to a dark potential VD=−500V. In addition to this charging bias voltage application, the control unit 1000 applies a +300V primary transfer bias voltage to the transfer roller 501. The control unit 1000 applies a +1000V cleaning bias voltage to the cleaning roller 504.

Then, the control unit 1000 controls the development separation mechanism 20 to rotate the developing devices 400 of the image forming stations Y, M, C, and K in a direction toward the drum 100 centering on the swinging center 404. As a result, in each of the image forming stations Y, M, C, and K, the development device 400 is changed to a development contact state (developing position) and held in this state in which the developing roller 401 is brought into contact with the drum 100 by a predetermined pressing force, as illustrated by the solid lines in FIG. 1B. The printer control unit 1000 rotatably drives the developing roller 401, and applies the developing bias voltage thereto.

First of all, in the yellow image forming station Y, the control unit 1000 controls the image exposure device 300 to perform exposure according to image information to form an electrostatic latent image on the surface of the drum 100. The surface of the drum 100 after the electrostatic latent image is formed thereon is set to a light potential VL=−150V. Applying a −300V developing bias voltage to the developing roller 401 develops the electrostatic latent image formed on the drum 100 into a yellow toner image. The +300V primary transfer bias voltage applied to the primary transfer roller 501 primarily transfers the yellow toner image onto the belt 502.

After primarily transferring the yellow toner image onto the belt 502, the surface potential of the drum 100 becomes about −250V at the dark potential VD portion and about 100V at the light potential VL portion because of the effect of the primary transfer bias voltage and the dark attenuation of the potential of the drum 100.

Similarly, in the magenta image forming station M, the control unit 1000 controls the image exposure device 300 to start exposure according to image information at a predetermined control timing to form an electrostatic latent image. Then, the control unit 1000 develops the electrostatic latent image into a magenta toner image, and transfers the magenta toner image onto the belt 502. Similarly, in the cyan image forming station C, the control unit 1000 forms a cyan toner image, and transfers the cyan toner image onto the belt 502. Finally, in the black image forming station K, the control unit 1000 forms a black toner image, and transfers the black toner image onto the belt 502.

In this way, the toner images formed on the drums 100 in the image forming stations Y, M, C, and K are sequentially transferred onto the belt 502 so that the toner images are placed on top of each other to form a 4-color full color toner image. The full color toner image for the first sheet formed on the belt 502 is moved toward the secondary transfer roller 503 by the rotation of the belt 502, and then secondarily transferred onto the recording material 900 at the secondary transfer portion.

The recording material 900 exiting the secondary transfer portion is separated from the belt 502 and then guided to the fixing device 800. Then, the fixing device 800 applies heat and pressure to the recording material 900 so that the unfixed toner image is fixed onto the recording material 900 as a fixed image. The recording material 900 with the image fixed thereon exits the fixing device 800, and then is discharged onto the discharge tray 705 as a full color image formed product.

Further, in each of the image forming stations Y, M, C, and K, the cleaning blade 601 removes the primary transfer residual toner remaining on the drum 100 after primary transfer of the toner image onto the belt 502, and the collection container 602 collects the removed toner.

In the yellow image forming station Y that has completed the image forming operation for the first sheet, the image exposure device 300 performs exposure according to the image information for the second sheet to form an electrostatic latent image. Then, the developing device 400 develops the electrostatic latent image into a yellow toner image, and the primary transfer roller 501 primarily transfers the yellow toner image onto the belt 502.

In this case, the +1000V cleaning bias voltage is applied to the cleaning roller 504, and the secondary transfer residual toner remaining on the belt 502 after image formation for the first sheet is charged to the positive polarity. Therefore, the drum 100 collects the secondary transfer residual toner remaining on the belt 502 at the same time as when the primary transfer roller 501 primarily transfers a yellow toner image for the second sheet onto the belt 502. The collected secondary transfer residual toner is accumulated in the cleaning device 600.

Likewise, in the magenta, cyan, and black image forming stations M, C, and K, toner images for the second sheet corresponding to respective colors are formed, and primarily transferred onto the belt 502 in sequence. Thus, a full color toner image is formed.

Then, the full color toner image for the second sheet formed on the belt 502 is moved toward the secondary transfer roller 503 by the rotation of the belt 502, and then secondarily transferred onto the recording material 900 at the secondary transfer portion. The recording material 900 exiting the secondary transfer portion is guided to the fixing device 800, subjected to toner image fixing processing, and then discharged onto the discharge tray 705 as a full color image formed product.

Repeating the above-described image forming operation forms a plurality of full color output images. When the rear end of the last output image is reached, the control unit 1000 controls the development separation mechanism 20 to separate the developing roller 401 from the drum 100 in each of the image forming stations Y, M, C, and K.

In each of the image forming stations Y, M, C, and K, after the last output full color toner image is transferred onto the belt 502, a charging bias voltage similar to that at the time of image formation and the primary transfer bias voltage remain applied. Then, the drum 100 collects the secondary transfer residual toner for the last output full color toner image on the belt 502.

After the rear end of the last output image is transferred onto the belt 502 in each of the image forming stations Y, M, C, and K, the belt 502 goes around, and a portion equivalent to the rear end of the last output image returns to the position of the former image forming station. At this timing, the control unit 1000 turns OFF all of the bias voltages. Then, the control unit 1000 stops rotating the drum 100, and the image forming apparatus A prepares for the next print request. Thus, the image forming apparatus A is held in the standby state until the following print request is received.

<Image Forming Apparatus Operation: Mono Color Mode>

Operations in the mono color mode as another image formation execution mode for forming a plurality of continuous black output images by using only the black image forming station K out of the image forming stations Y, M, C, and K.

Upon reception of a print request, the control unit 1000 starts rotating the drum 100 in each of the image forming stations Y, M, C, and K. Then, the charging bias power supply 202 applies the −1000V charging bias voltage to the charging roller 201 to charge the surface of the drum 100 to the dark potential VD=−500V. With the application of the charging bias voltage to the charging roller 201, the control unit 1000 applies a −500V non-collecting bias voltage to the primary transfer roller 501 in each of the image forming stations Y, M, and C. The control unit 1000 further applies the +300V primary transfer bias voltage to the primary transfer roller 501 of the image forming station K.

With the application of the primary transfer bias voltage to the primary transfer roller 501 of the image forming station K, the control unit 1000 applies the +1000V cleaning bias voltage to the cleaning roller 504.

Then, the control unit 1000 controls the development separation mechanism 20 in the black image forming station K to cause the developing roller 401 to contact the drum 100 only in the black image forming station K. In this case, the control unit 1000 controls the developing rollers 401 of the non-black color image forming stations (the image forming stations Y, M, and C) not to contact respective drums 100.

When the control unit 1000 controls the developing roller 401 to contact the drum 100 in the black image forming station K, the image exposure device 300 performs forced whole surface exposure in the non-black color image forming stations (the image forming stations Y, M, and C) not contributing to image formation.

Forced whole surface exposure refers to exposure to further extent than exposure for solid black image formation, i.e., exposure of the entire surface of the drum 100. As a result, in the non-black color image forming stations (the image forming stations Y, M, and C), the surface of the drum 100 is neutralized to about −70V through forced whole surface exposure. In each of the non-black color image forming stations (the image forming stations Y, M, and C), the secondary transfer residual toner remaining on the belt 502 positively charged by the cleaning roller 504 is hardly collected by forced whole surface exposure and the non-collecting bias voltage.

Forced whole surface exposure is performed for exposure of the entire surface of the drum 100 to further extent than exposure for solid black image formation to prevent the positively charged secondary transfer residual toner from being collected by the non-black color image forming stations (the image forming stations Y, M, and C). As a result, the secondary transfer residual toner remaining on the belt 502 can be collected by the black image forming station K.

Thus, in the mono color mode, the secondary transfer residual toner remaining on the belt 502 is collected only by the black image forming station K. If the secondary transfer residual toner is collected also in the non-black color image forming stations (the image forming stations Y, M, and C), waste toner accumulates in the cleaning devices 600 of the non-black color image forming stations (the image forming stations Y, M, and C) although image formation is performed only by the black image forming station K. For this reason, the secondary transfer residual toner is collected only by the black image forming station K to avoid a situation in which a non-black process cartridge (for example, the yellow process cartridge YC) needs to be replaced although only black toner is consumed.

Subsequently, in the black image forming station K, the image exposure device 300 performs exposure according to image information to form an electrostatic latent image on the surface of the drum 100. The developing roller 401 develops the electrostatic latent image formed on the drum 100 into a black toner image, and applies the +300V primary transfer bias voltage to the primary transfer roller 501 to primarily transfer the toner image onto the belt 502.

Thus, the black toner image for the first sheet formed on the belt 502 is moved toward the secondary transfer roller 503 by the rotation of the belt 502, and then secondarily transferred onto the recording material 900 at the secondary transfer portion. The recording material 900 exiting the secondary transfer portion is guided to the fixing device 800, subjected to the toner image fixing processing, and then discharged onto the discharge tray 705 as a mono color image formed product.

In the black image forming station K, the cleaning device 600 removes the primary transfer residual toner remaining on the drum 100 after primary transfer of the toner image onto the belt 502, and the collection container 602 collects the removed toner.

Subsequently, the black image forming station K shifts to the operation for black image formation for the second sheet. In the black image forming station K, the image exposure device 300 performs exposure according to image information for the second sheet to form an electrostatic latent image on the surface of the drum 100, and the developing roller 401 forms a black toner image. The +300V primary transfer bias voltage applied to the primary transfer roller 501 primarily transfers the black toner image onto the belt 502.

At this timing, the black toner image on the drum 100 is transferred onto the belt 502. At the same time, the drum 100 of the black image forming station K collects the secondary transfer residual toner remaining on the belt 502 in image formation for the first sheet positively charged by the cleaning roller 504.

Thus, the black toner image for the second sheet formed on the belt 502 is moved toward the secondary transfer roller 503 by the rotation of the belt 502, and then secondarily transferred onto the recording material 900 at the secondary transfer portion. The recording material 900 exiting the secondary transfer portion is guided to the fixing device 800, subjected to the toner image fixing processing, and then discharged onto the discharge tray 705 as a mono color image formed product.

Repeating the above-described image forming operation forms a plurality of black output images. In the non-black color image forming stations (the image forming stations Y, M, and C) after primary transfer of the last output black toner image, whole surface exposure, the non-collecting bias voltage, and the charging bias voltage at the time of image formation remain applied. Also in the black image forming station K, the charging bias voltage at the time of image formation and the primary transfer bias voltage remain applied.

Then, the control unit 1000 controls the development separation mechanism 20 to separate the developing roller 401 of the black image forming station K from the drum 100. Subsequently, when the black image forming station K has collected the secondary transfer residual toner of the black toner image at the rear end of the last output image, the control unit 1000 turns OFF whole surface exposure and all of the bias voltages. Then, the control unit 1000 stops the rotation of the drum 100, and the image forming apparatus A prepares for the following print request. Specifically, the image forming apparatus A is held in the standby state until the following print request is received.

<Longitudinal Configuration of Process Cartridge>

Figure 2A:
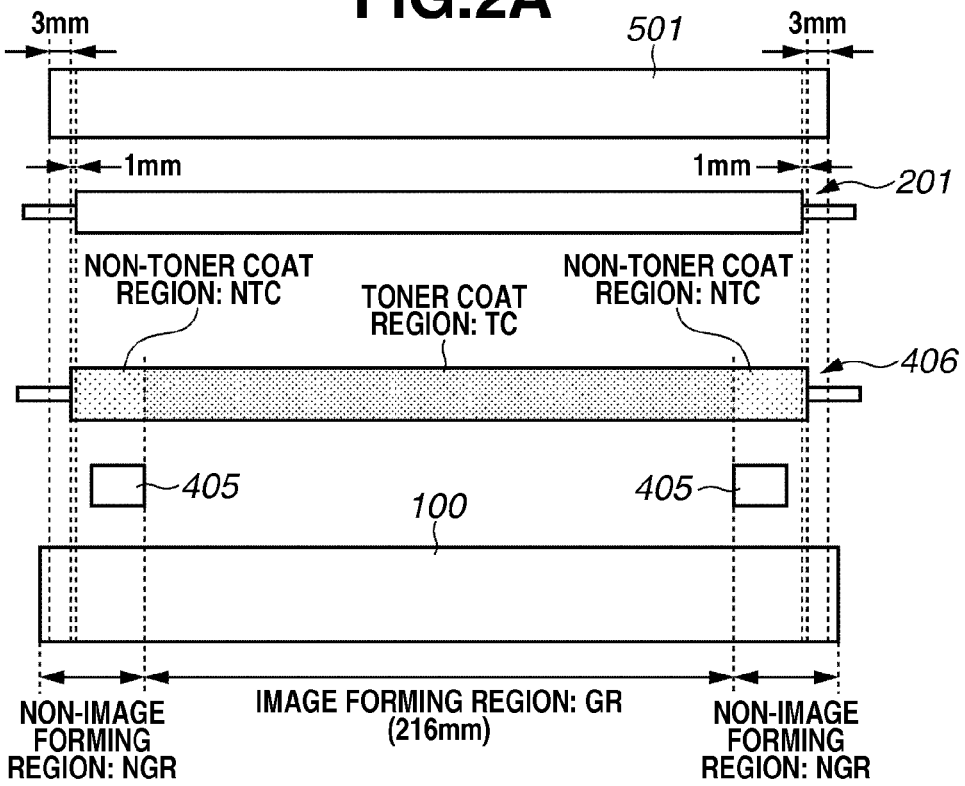
FIG. 2A schematically illustrates a longitudinal configuration of a photosensitive drum and a process unit acting thereon according to the first exemplary embodiment.

FIG. 2A illustrates longitudinal positional relations between the drum 100, the charging roller 201, the developing roller 401, and the cleaning blade 601 according to the first exemplary embodiment. In the image forming apparatus A according to the first exemplary embodiment, both longitudinal ends of members 201, 401, and 601 are disposed at close positions on the surface of the drum 100 to reduce the size of the image forming apparatus A. All of the image forming stations Y, M, C, and K have identical longitudinal positional relations between these members.

An end seal 405 for preventing toner leak from the hopper unit 403 is provided at both ends of the developing roller 401. The end seals 405 press both ends of the developing roller 401 to prevent toner leak from the hopper unit 403.

With the developing roller 401, the region on the inner side of the contact positions of the end seals 405 at both ends is a toner coat region (developer bearing region) TC which is coated by toner. In the present exemplary embodiment, the width (longitudinal dimension) of the toner coat region TC is 216 mm. With the developing roller 401, the regions on the outer side of the toner coat region TC are non-toner coat regions (developer non-bearing regions) NTC which are not coated by toner.

The region on the surface of the drum 100 contacting (corresponding to) the toner coat region TC of the developing roller 401 is an image forming region GR. The regions on the surface of the drum 100 on the outer side of the image forming region GR are non-image forming regions NGR.

The developing roller 401 can contact the drum 100. The developing roller 401 includes the toner coat region TC bearing toner over almost the same longitudinal range as the image forming region GR on the drum 100, and the non-toner coat regions NTC not bearing toner on the outer side of both ends of the toner coat region TC in the axial direction.

Both ends of the developing roller 401, i.e., the ends of the non-toner coat regions NTC are disposed on 1-mm outer side from both ends of the charging roller 201. Further, both ends of the cleaning blade 601 are disposed on 3-mm outer side from both ends of the developing roller 401. Therefore, both ends of the charging roller 201 and both ends of the developing roller 401 are within the scratching range of the cleaning blade 601.

Both longitudinal ends of the developing roller 401 and the charging roller 201 in contact with the drum 100 are disposed at close positions on the surface of the drum 100. Therefore, on the surface of the drum 100 in the vicinity of both longitudinal ends of the developing roller 401 and the charging roller 201, the CT layer is very susceptible to abrasion, as described above.

Specifically, the non-toner coat regions (toner non-application regions) NTC exist at both longitudinal ends of the developing roller 401. Therefore, the abrasion resulting from mechanical stress onto the drum 100 by the ends in the non-toner coat regions NTC of the developing roller 401 overlaps the abrasion resulting from increased amount of discharge at both end faces of the charging roller 201. Therefore, with the drum 100, the amount of CT layer abrasion at both longitudinal ends is larger than the amount of CT layer abrasion in the image forming region GR for image formation.

<Remaining CT Film Thickness Prediction for Photosensitive Drum 100>

The remaining CT film thickness prediction for the drum 100 for predicting the CT film thickness of the drum 100 of the image forming apparatus A, is described in detail.

The CT layer of the drum 100 is abraded with operating time of the image forming apparatus A. In the remaining CT film thickness prediction for the drum 100 described below, the control unit 1000 predicts the amount of CT layer abrasion in the image forming region GR of the drum 100 during image forming operation, and calculates the remaining CT film thickness of the drum 100.

The amount of CT layer abrasion of the drum 100 depends on how each of elements, such as the charging roller 201 and the developing device 400, acts on the drum 100 during image forming operation, i.e., depends on the following conditions:

When only the charging bias voltage is applied (condition 1),

When the charging bias voltage is applied, and forced whole surface exposure is performed by the non-black color image forming stations (the image forming stations Y, M, and C) not contributing to image formation in the mono color mode (condition 2), and When the charging bias voltage is applied, and the developing roller 401 is in contact with the drum 100 (condition 3).

First of all, under each of these conditions, the control unit 1000 measures a time duration during which the drum 100 is driven, and multiplies the measured time duration by the amount of abrasion per unit time to calculate the amount of abrasion S of the drum 100 (Formula 1).

The amount of abrasion per unit time under each condition is referred to as an abrasion coefficient. The first exemplary embodiment assumes abrasion coefficients for the three conditions as follows: an abrasion coefficient cc1 for the condition 1, an abrasion coefficient cc2 for the condition 2, and an abrasion coefficient cd1 for the condition 3. The first exemplary embodiment further assumes driving times of the drum 100 for the three conditions as follows: a time tc1 for the condition 1, a time tc2 for the condition 2, and a time td3 for the condition 3. Then, the amount of abrasion S is calculated by the formula 1.

$$S=(tc1\times cc1)+(tc2\times cc2)+(td3\times cd1) \quad \text{(Formula 1)}$$

The control unit 1000 calculates the remaining CT film thickness Nct of the drum 100 by subtracting the calculated amount of abrasion S of the drum 100 from a start CT film thickness Sct when the drum 100 is started being used (formula 2).

$$Nct=Sct-S \quad \text{(Formula 2)}$$

The control unit 1000 performs the above-described calculations for each image forming operation to successively update the remaining CT film thickness Nct of the drum 100. Thus, the control unit 1000 predicts the film thickness of the CT layer in the image forming region GR of the drum 100 with operating time of the image forming apparatus A. This completes descriptions of the remaining CT film thickness prediction for the drum 100 according to the first exemplary embodiment.

In the first exemplary embodiment, we set the abrasion coefficient cc1 for the condition 1, the abrasion coefficient cc2 for the condition 2, and the abrasion coefficient cd1 for the condition 3, as illustrated in Table 1.

TABLE 1

| Condition | Abrasion coefficient | Value (μm/sec.) |
|---|---|---|
| 1 | cc1 | 0.0000277 |
| 2 | cc2 | 0.0000606 |
| 3 | cd1 | 0.0000311 |

We acquired the value of each abrasion coefficient as the amount of abrasion per unit time under the above-described three conditions through the following experiment.

Condition 1: When only the charging bias voltage is applied to the drum 100.

In the image forming apparatus A, we executed the following experimental special sequence TS1. Specifically, with the developing roller 401 separated from the drum 100, we applied the −1000V charging bias and +300V primary transfer bias voltages at the same time as when the drum 100 was started rotating, and continuously operated the apparatus for 6 hours. Then, we measured the start CT film thickness before starting execution of the experimental special sequence TS1 and the CT film thickness after 6 hours elapsed, calculated the amount of abrasion of the drum 100 in the experimental special sequence TS1, and determined the abrasion coefficient cc1 for the condition 1 based on the calculated amount of abrasion of the drum 100.

Condition 2: When the charging bias voltage is applied to the drum 100, and forced whole surface exposure is performed.

In the image forming apparatus A, we executed the following experimental special sequence TS2. Specifically, with the developing roller 401 separated from the drum 100, we applied the −1000V charging bias and −600V transfer bias voltages, and performed forced whole surface exposure by the image exposure device 300 at the same time when the drum 100 was started rotating, and continuously operated the apparatus for 6 hours. Then, similar to the condition 1, we determined the abrasion coefficient cc2 for the condition 2 based on the amount of abrasion of the drum 100.

Condition 3: When the charging bias voltage is applied to the drum 100, and the developing roller 401 is in contact with the drum 100.

In the image forming apparatus A, we executed the following experimental special sequence TS3. Specifically, we drove the developing roller 401 and in a state of contacting the developing roller 401 to the drum 100, applied the −1000V charging bias and +300V primary transfer bias voltages at the same time as when the drum 100 was started rotating, and continuously operated the apparatus for 6 hours. Then, similar to the condition 1, we determined the abrasion coefficient cd1 for the condition 3 based on the amount of abrasion of the drum 100.

<Life Prediction for Photosensitive Drum 100>

The drum life prediction for predicting the life of the drum 100, which is a feature of an embodiment of the present invention, will be described in detail below.

In the drum life prediction according to an embodiment of the present invention, the control unit 1000 presets the drum life threshold value in the image forming region GR of the drum 100 when each of the plurality of image formation execution modes (full color and mono color modes in the present exemplary embodiment) is independently used. In the image forming apparatus A, the drum life threshold value is set in all of the image formation execution modes having different amounts of abrasion in the image forming region GR of the drum 100 and different amounts of abrasion in the non-image forming regions NGR of the drum 100.

Then, the control unit 1000 determines how frequently each color mode is used with operating time of the image forming apparatus A, i.e., calculates the "usage rate" in each color mode. Then, the control unit 1000 calculates "the photosensitive drum life threshold value according to the usage rate" based on the usage rate and the drum life threshold value preset for each color mode.

The control unit 1000 compares "the photosensitive drum life threshold value according to the usage rate" with the above-described remaining CT film thickness Nct of the drum 100 to determine whether the drum 100 has reached the end of the life.

As described above, the drum life prediction according to the first exemplary embodiment is applied to a case where, in the image forming apparatus A, the drum life threshold value in the image forming region GR differ for each color mode. In the first exemplary embodiment, with the drums 100 of the non-black color image forming stations (the image forming stations Y, M, and C), the drum life threshold value differs between the full color and mono color modes. The reason will be described below.

Therefore, the drum life prediction according to the first exemplary embodiment is applied to the drums 100 of the non-black color image forming stations (the image forming stations Y, M, and C). With the drum 100 of the black image forming station K, the drum life threshold value is the same in the full color and mono color modes. The reason will be described below. Therefore, the drum life prediction according to the first exemplary embodiment is not applied to the drum 100 of the black image forming station K.

The reason why the CT film thickness in the image forming region GR (serving as the drum life threshold value) differs between the full color and mono color modes in the drums 100 of the non-black color image forming stations (the image forming stations Y, M, and C), will be described.

In the full color mode, the developing roller 401 is constantly in contact with the drum 100 during image forming operation. Therefore, as described above, the CT layer abrasion is promoted at both longitudinal ends of the drum 100, and accordingly the CT layer abrasion at both longitudinal ends of the drum 100 increases.

Therefore, when printing is performed only in the full color mode, the time immediately before the CT layer abrasion at both longitudinal ends of the drum 100 reaches the resistive layer needs to be set as the life of the entire drum, to prevent leak at both longitudinal ends of the drum 100. Therefore, the control unit 1000 sets the film thickness of the CT layer in the image forming region GR of the drum 100 at this timing as the drum life threshold value.

We confirmed in an experiment using the image forming apparatus A the CT film thickness in the image forming region GR of the drum 100 immediately before the CT layer abrasion at both longitudinal ends of the drum 100 reached the resistive layer, i.e., immediately before the CT film thickness at both longitudinal ends of the drum 100 became 0 μm, when only the full color mode was used. The CT film thickness in the image forming region GR at this timing was 9 μm. Therefore, according to the first exemplary embodiment, we set the drum life threshold value when only the full color mode is used (the full color life threshold value Jfc) to 9 μm.

In the mono color mode, with the non-black color image forming stations (the image forming stations Y, M, and C), the drum 100 is not in contact with the developing roller 401 during image forming operation. Therefore, as described above, promoted CT layer abrasion at both longitudinal ends of the drum 100 as in the full color mode does not occur.

Therefore, when printing is performed only in the mono color mode, with the non-black color image forming stations (the image forming stations Y, M, and C), the life of the drum 100 is not affected by the CT layer abrasion at both longitudinal ends of the drum 100. Therefore, in this case, the CT layer film thickness immediately before an image failure occurs in the image forming region GR of the drum 100 can be set as the life of the drum 100.

We confirmed in an experiment the CT film thickness immediately before an image failure occurred in the image forming region GR of the drum 100 only when the mono color mode was used. Then, when the CT film thickness was below 7 μm, the dark attenuation of the dark potential VD of the drum 100 quickly progressed particularly in a high-temperature and high-humidity environment (30° C./80% Rh or higher). Therefore, we were not able to maintain an appropriate contrast between the developing bias voltage and the dark potential VD at the developing roller contact portion of the drum 100.

As a result, toner was developed to the dark potential VD. This phenomenon is what is called fogging. Therefore, we set the drum life threshold value when only the mono color mode is used (the mono color life threshold value Jmc) to 7 μm.

The drum 100 of the black image forming station K performs the same image forming operation in both the full color and mono color modes. In other words, the developing roller 401 is constantly in contact with the drum 100. Therefore, since the amount of CT layer abrasion of the drum 100 is the same in both the full color and mono color modes, it is not necessary to change the drum life threshold value between the two color modes. Therefore, the drum life prediction according to the first exemplary embodiment is not applied to the drum 100 of the black image forming station K.

The reason why a drum life threshold value according to the usage rate of each color mode is set, which is a feature of an embodiment of the present invention, will be described below.

When printing is performed only in the full color mode, the CT layer of the drum 100 can be used only up to 9 μm in the image forming region GR of the drum 100 because of the effect of the CT layer abrasion at both longitudinal ends of the drum 100, as described above. Accordingly, the remaining CT film thickness in the image forming region GR is 9 μm. However, when printing only in the full color mode is changed to printing only in the mono color mode before the 9-μm remaining film thickness is reached, there is almost no effect of the CT layer abrasion at both longitudinal ends of the drum 100. Therefore, there is no reason why the 9-μm remaining film thickness is set as the drum life threshold value.

This means that the usable amount of the CT layer in the image forming region GR of the drum 100 increases with increasing operating time in the mono color mode. However, for example, in a case where only one drum life threshold value (9 μm in the full color mode) was used in both color modes, 9 μm was used as the life of the drum 100 even with a long operating time in the mono color mode. This means that, although the CT film thickness in the image forming region GR of the drum 100 is below 9 μm (there remains a usable CT film thickness), the drum 100 has reached the end of the life with the usable CT film thickness unused.

According to the first exemplary embodiment, there is almost no effect of the CT layer abrasion at both longitudinal ends of the drum 100 when only the mono color mode is used. Therefore, the control unit 1000 performs control, by shifting the remaining CT film thickness in the image forming region GR from 9 μm close to 7 μm, to decrease the remaining CT film thickness with increasing operating time in the mono color mode. This processing enables outputting a greater number of print images in the mono color mode.

The drum life prediction when the image forming apparatus A is operated in a plurality of image formation execution modes in combination, which is a feature of an embodiment of the present invention, will be described in detail below.

The plurality of image formation execution modes means the full color and mono color modes. The control unit 1000 uses the drum life threshold value when each color mode is independently used (the full color life threshold value Jfc and the mono color life threshold value Jmc), and the printed-sheet number rate (hereinafter simply referred to as print rate) of the mono color mode. The procedures for calculating the combined color life threshold value E (the drum life threshold value according to the usage rates of the two color modes) is described below.

When the drum 100 is started being used, the full color life threshold value Jfc (the drum life threshold value in the full color mode) is set. First of all, the control unit 1000 performs the above-described remaining CT film thickness prediction for the drum 100 for each image forming operation. In this case, the control unit 1000 also counts the printed-sheet number of the full color mode, Pfc, and the printed-sheet number of the mono color mode, Pmc. Based on the counted number of sheets, the control unit 1000 calculates the print rate of the mono color mode, PHmc, i.e., the ratio of the number of sheets printed in the mono color mode to the total printed-sheet number (Formula 3).

$$PHmc=(Pmc)/(Pfc+Pmc) \quad \text{(Formula 3)}$$

By using the print rate of the mono color mode, PHmc, a new combined color life threshold value E is set between the full color life threshold value Jfc and the mono color life threshold value Jmc. The control unit 1000 calculates the combined color life threshold value E by multiplying a difference between the full color life threshold value Jfc and the mono color threshold value Jmc by the print rate of the mono color mode, PHmc, and subtracting the result from the full color life threshold value Jfc (Formula 4). Thus, the control unit 1000 shifts the life threshold value of the drum 100 from the full color life threshold value Jfc to the mono color life threshold value Jmc by the print rate of the mono color mode, PHmc.

$$E=Jfc-\{PHmc\times(Jfc-Jmc)\} \quad \text{(Formula 4)}$$

The control unit 1000 compares the combined color life threshold value E according to the usage rate of each color mode with the remaining CT film thickness Nct of the drum 100 calculated in the remaining CT film thickness prediction for the drum 100. Then, the control unit 1000 displays on the operation panel 706 the time when the remaining CT film thickness Nct of the drum 100 has reached the combined color life threshold value E to notify the user of the life of the drum 100.

The control unit 1000 performs the above-described series of calculations for each image formation process to successively update the combined color life threshold value E and the remaining CT film thickness Nct of the drum 100. Performing processing in this way enables calculating the combined color life threshold value E according to the usage rate of each image formation execution mode of the image forming apparatus A, and setting as the life of the drum 100 the time when the remaining CT film thickness Nct of the drum 100 has reached the combined color life threshold value E. This completes descriptions of the drum life prediction according to the first exemplary embodiment.

Figure 3A:
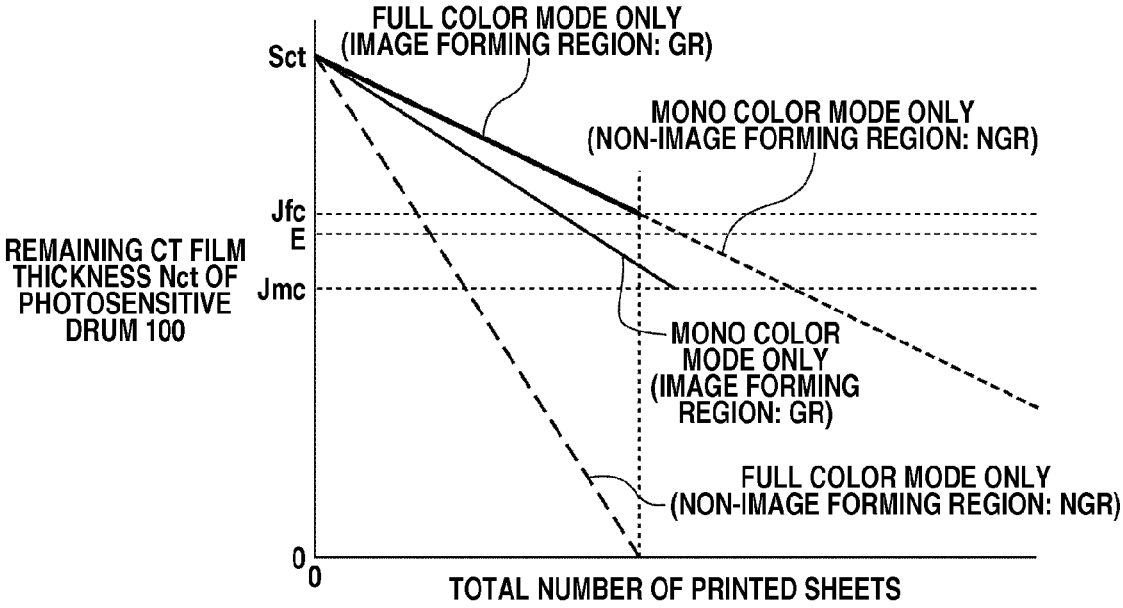
FIG. 3A is a graph illustrating transitions of the remaining CT film thickness Nct in an image forming region GR and in non-image forming regions NGR of a photosensitive drum 100 with increasing number of printed sheets (hereinafter referred to as printed-sheet number) when only the full color mode is used and when only the mono color mode is used according to the first exemplary embodiment.

FIG. 3A illustrates transitions of the remaining CT film thickness Nct in the image forming region GR and in the non-image forming regions NGR of the drum 100 with increasing printed-sheet number when the image forming apparatus A is operated only in the full color mode and only in the mono color mode.

Specifically, the thick line indicates the transition of the remaining CT film thickness Nct in the image forming region GR of the drum 100 with increasing printed-sheet number when only the full color mode is used. The thick dotted line indicates the transition of the CT film thickness in the non-image forming regions NGR of the drum 100 with increasing printed-sheet number when only the full color mode is used. The thin line indicates the transition of the remaining CT film thickness Nct in the image forming region GR of the drum 100 with increasing printed-sheet number when only the mono color mode is used. The thin dotted line indicates the transition of the CT film thickness in the non-image forming regions NGR of the drum 100 with increasing printed-sheet number when only the mono color mode is used.

Figure 3B:
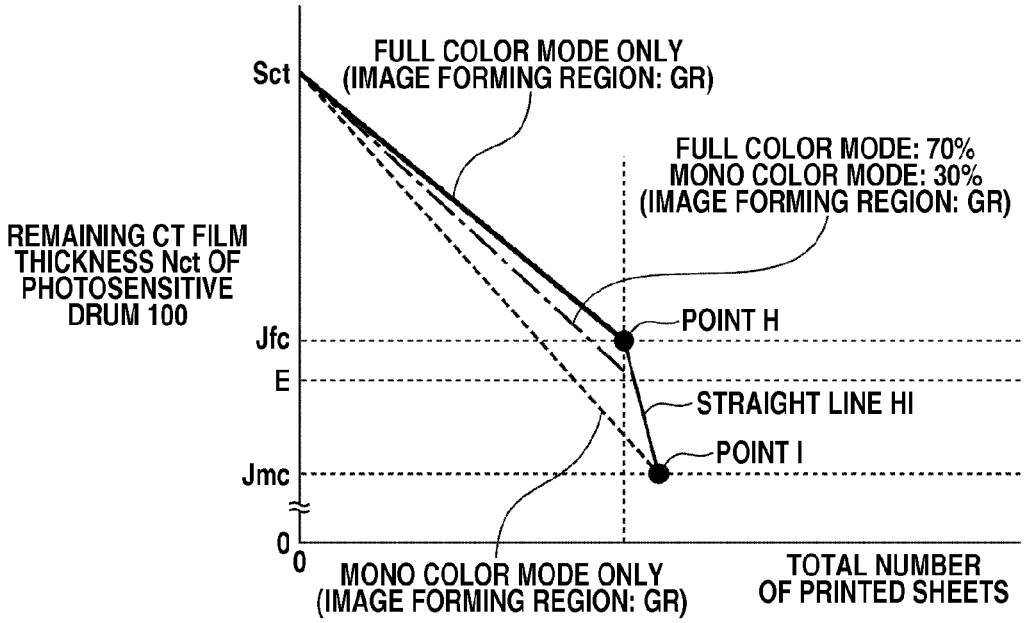
FIG. 3B is a graph illustrating transitions of the remaining CT film thickness Nct in the image forming region GR of the photosensitive drum 100 with increasing printed-sheet number when only the full color mode is used, when only the mono color mode is used, and when the two color modes are used in combination according to the first exemplary embodiment.

FIG. 3B illustrates transitions of the remaining CT film thickness Nct in the image forming region GR of the photosensitive drum 100 with increasing printed-sheet number when the image forming apparatus A is operated only in the full color mode and only in the mono color mode. FIG. 3B further illustrates a transition of the remaining CT film thickness Nct in the image forming region GR of the photosensitive drum 100 with increasing printed-sheet number when the image forming apparatus A is operated by using the two color modes in combination (70% full color mode and 30% mono color mode).

The thick line indicates the transition of the remaining CT film thickness Nct in the image forming region GR of the drum 100 with increasing printed-sheet number when printing is performed only in the full color mode. The thin line indicates the transition of the remaining CT film thickness Nct in the image forming region GR of the drum 100 with increasing printed-sheet number when printing is performed only in the mono color mode. The chain line indicates the transition of the remaining CT film thickness Nct in the image forming region GR of the drum 100 with increasing printed-sheet number when printing is performed by using the two color modes in combination (70% full color mode and 30% mono color mode).

Referring to FIG. 3B, the transition of the remaining CT film thickness Nct with increasing printed-sheet number when only the full color mode is used and when only the mono color mode is used is similar to that illustrated in FIG. 3A.

FIGS. 3A and 3B illustrate what is called 2-sheet intermittent printing in which the image forming operation for continuous two sheets is repeated by the image forming stations Y, M, and C. The transition of the remaining CT film thickness Nct of the drum 100 with increasing printed-sheet number is similar to that for the image forming stations Y, M, and C. The horizontal axis is assigned the total printed-sheet number of the two color modes, and the vertical axis is assigned the remaining CT film thickness Nct of the drum 100.

The full color life threshold value Jfc (the drum life threshold value when only the full color mode is used) is 9 μm. The mono color life threshold value Jmc (the drum life threshold value when only the mono color mode is used) is 7 μm. In the first exemplary embodiment, the combined color life threshold value E (the drum life threshold value according to the usage rate of the mono color mode) is $9-\{0.3\times(9-7)\}=8.4$ μm.

When the image forming apparatus A is operated only in the mono color mode, since forced whole surface exposure is applied to the drum 100 of the image forming stations Y, M, and C, the discharge amount by the charging roller 201 increases to increase the amount of CT layer abrasion.

As illustrated in FIG. 3A, when printing was performed only in the full color mode, the remaining CT film thickness Nct in the image forming region GR reached the full color life threshold value Jfc=9 μm when the CT film thickness reached 0 μm in the non-image forming regions NGR, i.e., at both longitudinal ends of the drum 100. When printing is performed only in the mono color mode, the CT film thickness did not reach 0 μm in the non-image forming regions NGR even when the remaining CT film thickness Nct in the image forming region GR reached the mono color life threshold value Jmc=7 μm. The end of the drum life was notified when the remaining CT film thickness Nct reached the full color life threshold value Jfc and the mono color life threshold value Jmc in the full color and mono color modes, respectively.

Referring to FIG. 3B, when printing was performed only in the full color mode, the remaining CT film thickness Nct reached the full color life threshold value Jfc=9 μm. When printing is performed only in the mono color mode, the remaining CT film thickness Nct reached the mono color life threshold value Jmc=7 μm. Further, when printing was performed by using the two color modes in combination (70% full color mode and 30% mono color mode), the remaining CT film thickness Nct reached the combined color life threshold value E=8.4 μm calculated according to the print rate of the mono color mode. At this timing, the end of the drum life was notified.

In any of these case, we were able to acquire favorable images without leak at both longitudinal ends of the drum 100 and an image failure due to fogging until the remaining CT film thickness Nct reached the drum life threshold values Jfc, Jmc, and E.

The combined color life threshold value E calculated according to the print rates of the two color modes, will be additionally described below.

Referring to FIG. 3B, the transitional line of the remaining CT film thickness Nct in the image forming region GR of the drum 100 when only the full color mode is used intersects with the full color life threshold value Jfc (the drum life threshold value when only the full color mode is used) at an intersecting point H. The transitional line of the remaining CT film thickness Nct in the image forming region GR of the drum 100 when only the mono color mode is used intersects with the mono color life threshold value Jmc (the drum life threshold value when only the mono color mode is used) at an intersecting point I.

As described above, the combined color life threshold value E is calculated according to the print rates of the two color modes. Therefore, when printing is performed by using the two color modes in combination, the combined color life threshold value E (the drum life threshold value according to the usage rates of the two color modes) is set on a straight line HI connecting the above-described points H and I. Therefore, the combined color life threshold value E shifts toward the point H with increasing usage rate of the full color mode, and shifts toward the point I with increasing usage rate of the mono color mode.

Also when printing is performed by using the two color modes in combination, therefore, the drum 100 reaches the end of the life on the straight line HI without leak at both longitudinal ends (in the non-image forming regions NGR) of the drum 100 and fogging due to dark attenuation in the image forming region GR thereof.

<Photosensitive Drum Life Prediction Device>

Figure 1B:
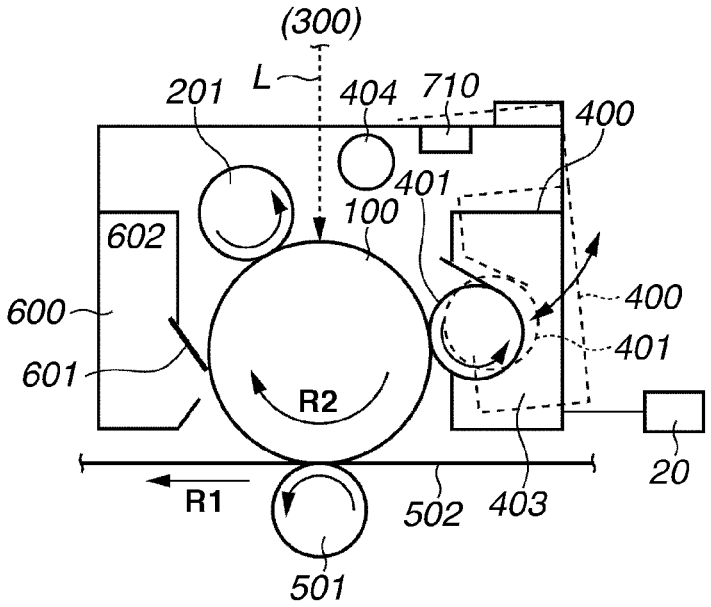
FIG. 1B illustrates a development separation mechanism of a developing device.

As illustrated in FIGS. 1A and 1B, the drum life prediction device 707 is attached to the image forming apparatus A according to the first exemplary embodiment. The drum life prediction device 707 includes a remaining CT film thickness prediction device 708 for predicting the remaining CT film thickness Nct of the drum 100, and a life determination device 709 for determining whether the drum 100 has reached the end of the life.

In the first exemplary embodiment, the above-described drum life prediction device 707, the remaining CT film thickness prediction device 708, and the life determination device 709 are implemented as a drum life prediction function unit, a remaining CT film thickness prediction function unit, and a life determination function unit, respectively, in the control unit 1000.

Each of the cartridges YC, YM, CC, and KC includes a memory 710. The memory 710 may be, for example, a contact nonvolatile memory, a non-contact nonvolatile memory, a volatile memory including a power supply, and any other desired forms. Information can be written and read to and from the memory 710 through communication with the control unit 1000. Thus, the control unit 1000 is provided with functions of writing and reading information to/from the memory 710.

Each memory 710 stores information about the drum 100 of the corresponding cartridge. The information about the drum 100 includes the drum life threshold values (Jfc and Jmc), the abrasion coefficients (cc1, cc2, and cd1), the printed-sheet numbers (Pfc and Pmc), the remaining CT film thickness Nct of the drum 100, and the start CT film thickness Sct of the drum 100.

The printed-sheet numbers (Pfc and Pmc) is "0" when the process cartridges YC, YM, CC, and KC are started being used, and successively updated with operating time of the image forming apparatus A. When the timing sensor 703 detects a recording material 900 sent out from the cassette 700, and the detected information is input in the control unit 1000, the drum life prediction device 707 of the control unit 1000 increments the printed-sheet number. Based on the counted printed-sheet number, the control unit 1000 successively updates the information about the printed-sheet numbers (Pfc and Pmc) stored in each memory 710.

The remaining CT film thickness Nct of the drum 100 is "13 μm" when the cartridges YC, YM, CC, and KC are started being used, and successively updated with operating time of the image forming apparatus A.

The drum 100 of the black image forming station K performs the same image forming operation in the full color and mono color modes, as described above, so that the amount of CT layer abrasion is the same in both color modes. That is, the drum 100 of the black image forming station K constantly performs the image forming operation in the full color mode. Therefore, the drum life prediction according to the first exemplary embodiment is not applied to the black image forming station K.

However, the remaining CT film thickness prediction for the drum 100 and life prediction control for the drum 100 based on a drum life threshold value, as discussed in Japanese Patent Application Laid-Open No. 2001-356655, are performed. Therefore, the memory 710 of the cartridge KC stores the full color life threshold value Jfc, abrasion coefficients (cc1 and cd1), and the printed-sheet number Pfc, which correspond to the full color mode. The memory 710 further stores the remaining CT film thickness Nct of the drum 100 and the start CT film thickness Sct of the drum 100.

In the image forming operation, the remaining CT film thickness prediction device 708 detects which of the conditions 1 to 3 is satisfied, measures the time for the detected condition 1, 2, or 3, predicts the remaining CT film thickness Nct of the drum 100, and stores the predicted value in the memory 710.

Based on the result of the detection by the timing sensor 703, the life determination device 709 counts the printed-sheet numbers (Pfc and Pmc) in each color mode. The life determination device 709 calculates the print rate PHmc based on the counted printed-sheet numbers (Pfc and Pmc), and stores the printed-sheet numbers (Pfc and Pmc) in the memory 710. The life determination device 709 further calculates the combined color life threshold value E based on the print rate PHmc, and compares the result with the remaining CT film thickness Nct of the drum 100 to determine whether the drum 100 has reached the end of the life.

<Photosensitive Drum Life Determination Sequence>

Figure 4:
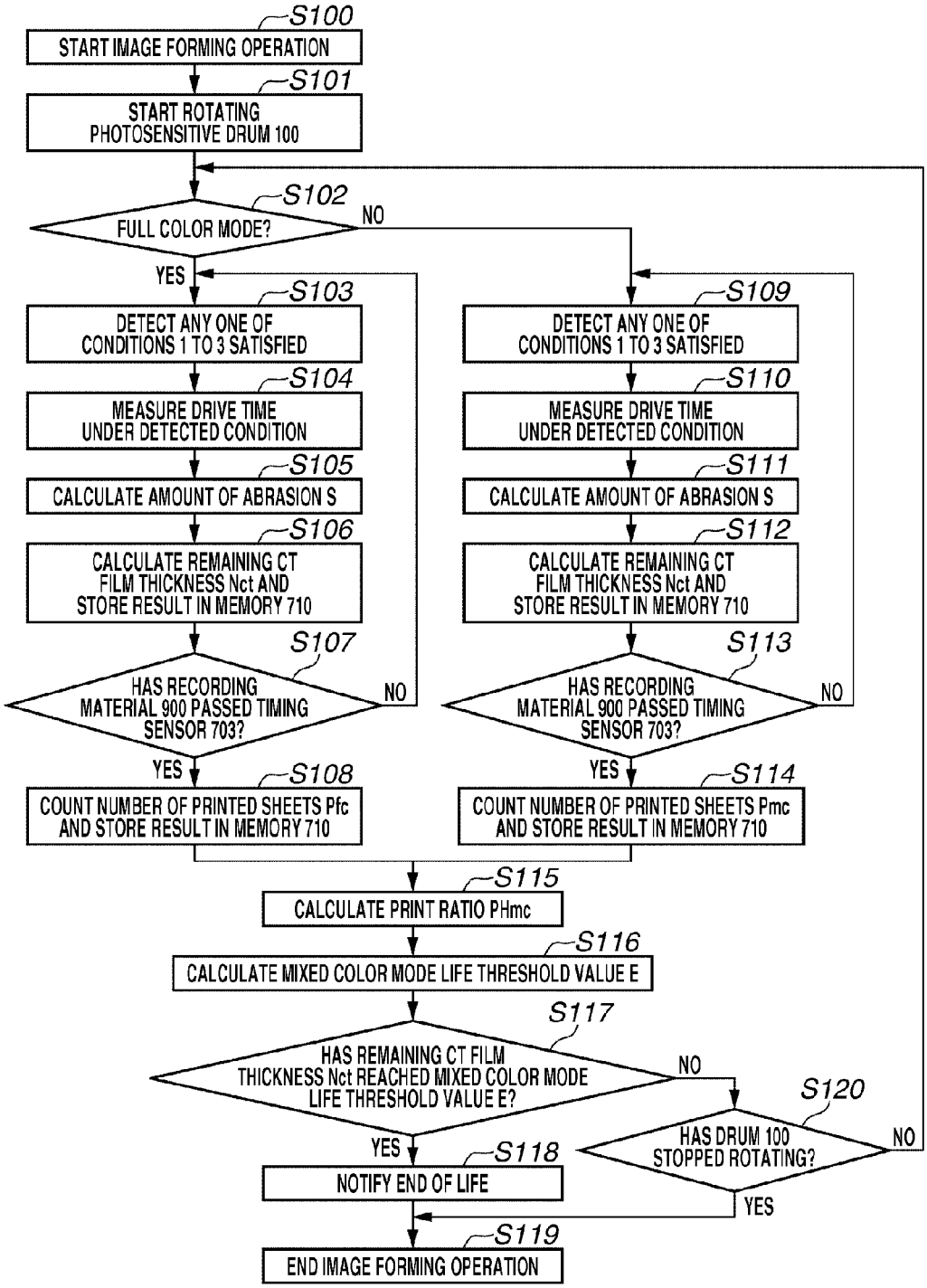
FIG. 4 is a flowchart illustrating processing for determining the life of the photosensitive drum 100 according to the first exemplary embodiment.

FIG. 4 is a sequence chart illustrating processing for determining the life of the drum 100 according to the first exemplary embodiment. The drum life prediction device 707 performs processing in each step of the flowchart in FIG. 4 based on information stored in the memory 710 of the cartridges YC, YM, and CC. Thus, the control unit 1000 predicts and determines the drum life, and displays the result of the prediction on the operation panel 706 to notify the user of the result.

In step S100, upon reception of a print request, the control unit 1000 starts the image forming operation. In step S101, the control unit 1000 starts rotating the drum 100. In step S102, the control unit 1000 determines whether the print request specifies the full color mode. When the print request is determined to specify the full color mode (YES in step S102), then in step S103, the control unit 1000 detects which of the conditions 1 to 3 is satisfied by the remaining CT film thickness prediction device 708.

In step S104, the control unit 1000 measures the driving time of the drum 100 under the detected condition. In step S105, based on the measured time and the abrasion coefficients (cc1, cc2, and cd1) stored in the memory 710, the control unit 1000 calculates the amount of abrasion S of the drum 100. In step S106, based on the calculated amount of abrasion S and the start CT film thickness Sct when the drum 100 is started being used stored in the memory 710, the control unit 1000 calculates the remaining CT film thickness Nct of the drum 100, and stores the calculated value in the memory 710.

In step S107, the control unit 1000 determines whether the recording material 900 has passed the timing sensor 703. When the recording material 900 is determined to have not passed the timing sensor 703 (NO in step S107), the processing returns to step S103, and the control unit 1000 detects again which of the conditions 1 to 3 is satisfied by the remaining CT film thickness prediction device 708. On the other hand, when the recording material 900 is determined to have passed the timing sensor 703 (YES in step S107), then in step S108, the control unit 1000 increments the printed-sheet number Pfc, and stores the counted value in the memory 710.

When the print request is determined to specify not the full color mode but the mono color mode (NO in step S102), then in step S109, the control unit 1000 detects which of the conditions 1 to 3 is satisfied by the remaining CT film thickness prediction device 708. In step S110, the control unit 1000 calculates the driving time of the drum 100 under the detected condition. In step S111, the control unit 1000 calculates the amount of abrasion S of the drum 100. In step S112, the control unit 1000 calculates the remaining CT film thickness Nct of the drum 100, and stores the calculated value in the memory 710.

In step S113, the control unit 1000 determines whether the recording material 900 has passed the timing sensor 703. When the recording material 900 is determined to have not passed the timing sensor 703 (NO in step S113), the processing returns to step S109, and the control unit 1000 detects again which of the conditions 1 to 3 is satisfied by the remaining CT film thickness prediction device 708. On the other hand, when the recording material 900 is determined to have passed the timing sensor 703 (YES in step S113), then in step S114, the control unit 1000 increments the printed-sheet number Pmc, and stores the counted value in the memory 710.

In step S115, after incrementing the printed-sheet numbers (Pfc and Pmc) and storing the counted values in the memory 710, the control unit 1000 calculates the print rate of the mono color mode, PHmc. In step S116, based on the calculated print rate PHmc, and the full color life threshold value Jfc and the mono color life threshold value Jmc stored in the memory 710, the control unit 1000 calculates the combined color life threshold value E.

In step S117, the control unit 1000 determines whether the remaining CT film thickness Nct of the drum 100 has reached the combined color life threshold value E. When the remaining CT film thickness Nct of the drum 100 is determined to have reached the combined color life threshold value E (YES in step S117), then in step S118, the control unit 1000 notifies that the drum 1000 has reached the end of the life on the operation panel 706. In step S119, the control unit 1000 ends the image forming operation.

On the other hand, when the remaining CT film thickness Nct of the drum 100 is determined to have not reached the combined color life threshold value E (NO in step S117), then in step S120, the control unit 1000 determines whether the drum 100 has stopped rotating. When the drum 100 is determined to have stopped rotating (YES in step S120), then in step S119, the control unit 1000 ends the image forming operation. On the other hand, when the drum 100 is determined to be still rotating (NO in step S120), the processing returns to step S102, and the control unit 1000 determines again whether the print request specifies the full color mode.

The control unit 1000 performs the above-described sequence for determining the life of the drum 100, independently for each of the cartridges YC, MC, and CC, to determine whether respective drums have reached the end of the life.

With the black cartridge KC, the control unit 1000 performs the above-described sequence excluding the determination whether the print request specifies the full color mode (step S101), the calculation of the print rate PHmc (step S115), and the calculation of the combined color life threshold value E (step S116). In determining whether the remaining CT film thickness Nct has reached the combined color life threshold value E (step S117), the control unit 1000 determines whether the remaining CT film thickness Nct of the drum 100 has reached the full color life threshold value Jfc, not the combined color life threshold value E. Other steps are similar to those in the sequence illustrated in FIG. 4.

The control unit 1000 performs the sequence in this way to determine the life of the drum 100 of the black cartridge KC independently of the non-black color cartridges YC, MC, and CC.

Executing processing in this flowchart enables acquiring the following effects. Specifically, in the non-black color image forming stations (the image forming stations Y, M, and C), the drum 100 can be used up to a more appropriate remaining CT film thickness even when the full color and mono color modes are used in combination. Thus, it is possible to prevent the drum 100 from being determined to have reached the end of the life although image formation is still possible, and prevent the drum 100 from being continuously used although image formation is no longer possible.

In the first exemplary embodiment, the control unit 1000 acquired the combined color life threshold value E by calculating the print rate of the mono color mode, PHmc. However, the combined color life threshold value E can also be acquired by calculating the print rate of the full color mode, PHfc.

In this case, the control unit 1000 calculates a difference between the full color life threshold value Jfc (the drum life threshold value when only the full color mode is used) and the mono color life threshold value Jmc (the drum life threshold value when only the mono color mode is used). Then, the control unit 1000 multiplies the calculated difference by the print rate of the full color mode, PHfc, and adds the result to the mono color life threshold value Jfc to calculate the combined color life threshold value E according to the usage rate.

In the first exemplary embodiment, the control unit 1000 acquired the usage rate of the mono color mode by calculating the print rate of the mono color mode, PHmc, i.e., the ratio of the number of sheets printed in the mono color mode to the total printed-sheet number. In other words, the usage rate of each of a plurality of image formation execution modes is defined as the image-formed sheet number rate of each of the plurality of image formation execution modes with respect to the total image-formed sheet number.

However, the usage rate of each color mode may be acquired based not on the print rate but on the time duration during which the developing roller 401 is in contact with the drum 100 in image forming operation. In this case, it is preferable to use, for example, the developing roller contact time duration in the full color mode, and the virtual developing roller contact time duration during which the developing roller 401 is assumed to be in contact with the drum 100 even in the mono color mode. It is preferable to calculate the usage rates of the full color and mono color modes by using the developing roller contact time duration in the full color mode and the virtual developing roller contact time duration in the mono color mode, with respect to the total rotation time duration since the time when the developing roller 401 is started being used.

Thus, the usage rate of each of a plurality of image formation execution modes may also be defined as the rate of rotation time duration during which the developing roller 401 is in contact with the drum 100 in each of the plurality of image formation execution modes with respect to the total rotation time duration of the developing roller 401.

In short, the usage rate may be defined by any index as long as it indicates how long each of the full color and mono color modes has been used.

The image forming apparatus A according to the first exemplary embodiment is described to have the full color and mono color modes as a plurality of image formation execution modes having different amounts of abrasion in the image forming region of the drum 100 and different amounts of abrasion in the non-image forming regions of the drum 100. However, the plurality of image formation execution modes is not limited to the two color modes.

An embodiment of the present invention is also applicable to a case where the image forming apparatus A has a plurality of image formation execution modes having different printing speeds. For example, the image forming apparatus A may have the plain paper mode for printing on plain paper, such as office automation (OA) paper, and a thick paper mode for printing on thick paper. Further, the an embodiment of present invention is also applicable to a case where the image forming apparatus A has three or more color modes, such as the plain paper mode, the thick paper mode, and the glossy paper mode for printing on glossy paper.

For example, when the image forming apparatus A has three image formation execution modes, the control unit 1000 first sets the drum life threshold value for each of the three modes. Then, by using the drum life threshold values for any two color modes (for example, the plain paper and thick paper modes), the control unit 1000 calculates a 2-combined color life threshold value based on the usage rates of the two color modes. Then, regarding the two color modes used for the calculation of the 2-combined color life threshold value as one mode, the control unit 1000 calculates a 3-combined color life threshold value by using the 2-combined color life threshold value and the drum life threshold value of the remaining one mode (for example, the glossy paper mode).

In other words, the control unit 1000 calculates the final combined color life threshold value E based on the usage rates of the 2-combined color mode (combining the plain paper and thick paper modes) and the glossy paper mode. Thus, an embodiment of the present invention is also applicable to a case where the image forming apparatus A has three or more modes.

An embodiment of the present invention is also applicable not only to a full color image forming apparatus but also to a mono color image forming apparatus which performs mono color image formation.

In short, an embodiment of the present invention is applicable to a case where, when the image forming apparatus A is operated in a plurality of image formation execution modes in combination, the life threshold value of the drum 100 differs for each image formation execution mode.

In the first exemplary embodiment, the control unit 1000 calculates the remaining CT film thickness Nct of the drum 100, and compares the calculated value with the drum life threshold values Jfc, Jmc, and E to determine whether the drum 100 has reached the end of the life. However, the control unit 1000 may determine the life of the drum 100 by using the amount of abrasion S of the drum 100 instead of the remaining CT film thickness Nct. More specifically, the control unit 1000 determines the time when the amount of abrasion S reaches a predetermined threshold value as the life of the drum 100.

In this case, it is necessary to set as a threshold value the usable CT film thickness since the time when the drum 100 is started being used, instead of setting the remaining CT film thickness of the drum 100 described in the first exemplary embodiment as the drum life threshold values Jfc, Jmc, and E. Setting a threshold value in this way enables determining whether the drum 100 has reached the end of the life, similar to the first exemplary embodiment.

In addition, in the first exemplary embodiment, the time when the remaining CT film thickness Nct of the drum 100 reaches the combined color life threshold value E according to the print rate, is set as the life of the drum 100. However, the processing is not limited thereto, and the control unit 1000 can perform processing as follows.

Specifically, assuming that the start CT film thickness Sct when the drum 100 is started being used is remaining life 100%, and the calculated combined color life threshold value is remaining life 0%, the control unit 1000 can also update the remaining life (%) of the drum 100 each time the remaining CT film thickness Nct of the drum 100 and the combined color life threshold value E are updated. In this case, the control unit 1000 displays the remaining life (%) of the drum 100 on the operation panel 706 to notify the user of the remaining life of the drum 100.

When the remaining life (%) is 15%, for example, the control unit 1000 displays a preliminary warning about the drum 100 on the operation panel 706 to notify the user that the drum 100 has come to close to the end of the life. Thus, the user can prepare a new cartridge before any one of the cartridges (YC, YM, CC, and KC) reaches the end of the life. Thus, an embodiment of the present invention enables providing an image forming apparatus A having excellent usability.

Next, a second exemplary embodiment of the present invention will be described. In the second exemplary embodiment, a rotary type full color image forming apparatus which employs different developing methods between the developing devices of the yellow, magenta, and cyan image forming stations Y, M, and C, and the developing device of the black image forming station K, will be described. The calculation of the drum life threshold value (combined color life threshold value) according to the print rate when printing is performed by using the full color and mono color modes in combination (i.e., feature of an embodiment of the present invention), and the drum life prediction based on the combined color life threshold value, will be described.

<Image Forming Apparatus>

Figure 5:
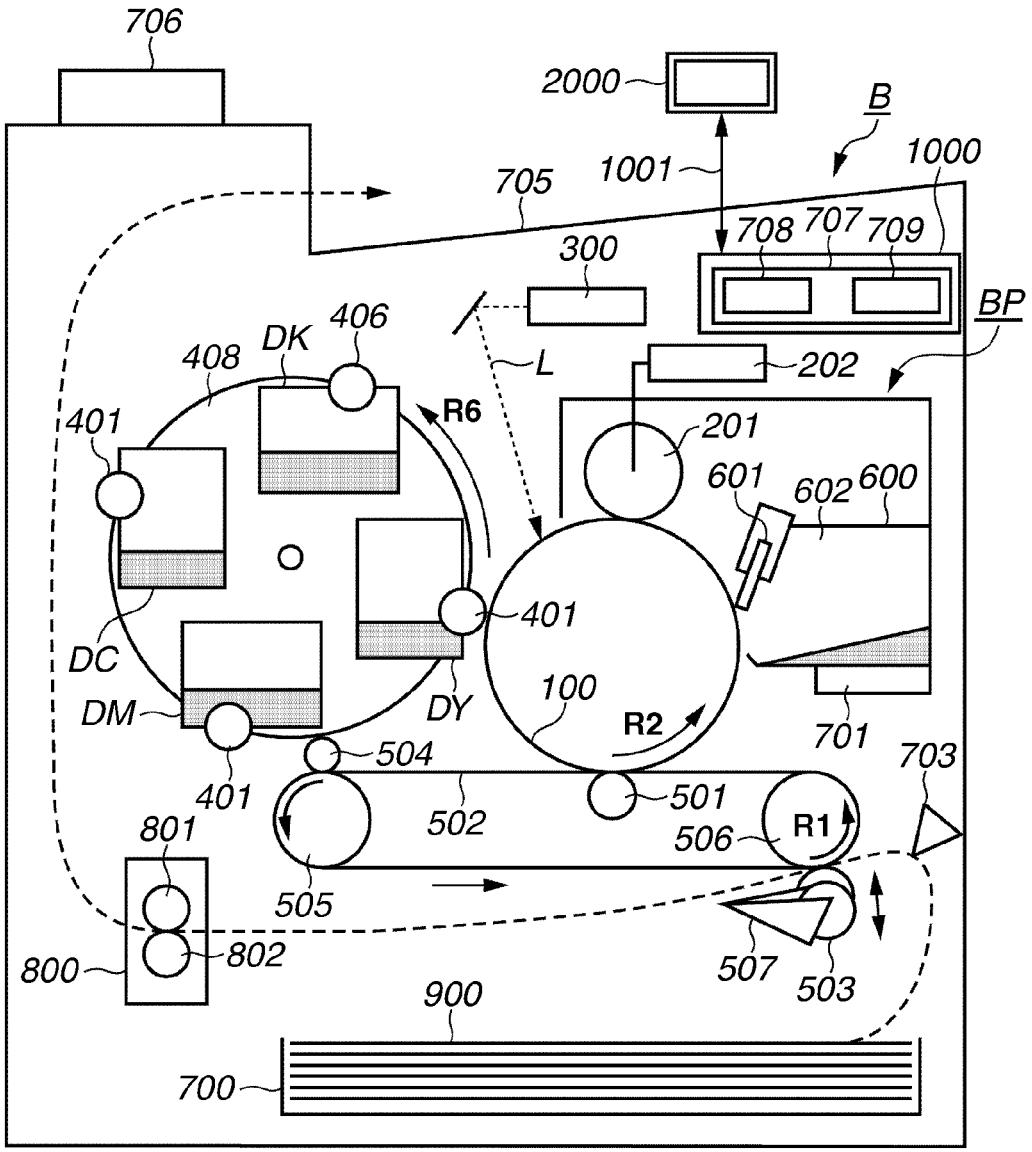
FIG. 5 schematically illustrates an image forming apparatus B according to the second exemplary embodiment.

FIG. 5 schematically illustrates an image forming apparatus B according to the second exemplary embodiment. The image forming apparatus B according to the second exemplary embodiment is an one-drum type electrophotographic image forming apparatus which performs a series of image formation processes including charging, exposure, development, transfer, and cleaning to one drum 100 to form a full color or mono color image on a recording material 900.

The image forming apparatus B includes four developing devices DY, DM, DC, and DK, and a rotary drum 408. In other words, the rotary drum 408 is a rotary developing unit installation unit enabling disposing a plurality of developing units, i.e., the developing devices DY, DM, DC, and DK.

The image forming apparatus B is a rotary type full color image forming apparatus which forms four color images one by one on one drum 100, and sequentially transfers the images onto the belt 502 so that the images are placed on top of each other.

The image forming apparatus B includes the drum 100 as an image bearing member, a charging roller 201 as a charging device for charging the drum 100, and an image exposure device 300 for performing exposure for the charged drum 100 according to image data to form an electrostatic latent image. The image forming apparatus B further includes the developing devices D for developing the electrostatic latent image formed on the drum 100 into a visible toner image by using toner (developer), and an intermediate transfer belt 502 as an intermediate transfer member to which the toner image of each color developed on the drum 100 is transferred.

The image forming apparatus B further includes a secondary transfer roller 503 for collectively transferring onto a recording material 900 the toner images of respective colors transferred onto the belt 502. The image forming apparatus B further includes a fixing device 800 for fixing the toner image on the recording material 900, and a cleaning device 600 for cleaning the surface of the drum 100 after transfer.

The drum 100 is formed of a resistive layer, an under coat layer, a charge generation layer, and a charge transport (CT) layer sequentially laminated on an aluminum cylinder by using the dipping coating method. The drum 100 rotates in the direction indicated by the arrow R2 centering on the axis of the cylinder. In the second exemplary embodiment, the film thickness of the CT layer when the drum 100 is started being used, was set to 13 μm.

The charging roller 201 is formed of a metallic core, an elastic layer made of a conductive material surrounding the metal core, and a surface layer formed of a high resistance layer on the surface of the elastic layer. The charging roller 201 is disposed in contact with the drum 100 to be rotatably driven by the rotation of the drum 100. A charging bias power supply 202 can apply a charging bias voltage to the charging roller 201.

The developing devices DY, DM, DC, and DK according to the second exemplary embodiment have an identical shape regardless of the toner color. The developing device DY forms a yellow toner image, the developing device DM forms a magenta toner image, the developing device DC forms a cyan toner image, and the developing device DK forms a black toner image.

The developing devices DY, DM, DC, and DK are detachably attached to the rotary drum 408, and therefore can be easily detached and attached from and to the image forming apparatus B. With the rotary drum 408, installation positions corresponding to the four colors are specified. In addition, a position of the developing devices DY, DM, DC, and DK at which each of the developing rollers 401 and a developing sleeve 406 provided thereon comes close to the drum 100 by a predetermined distance to develop an electrostatic latent image on the drum 100 is referred to as a developing position.

Figure 6A:
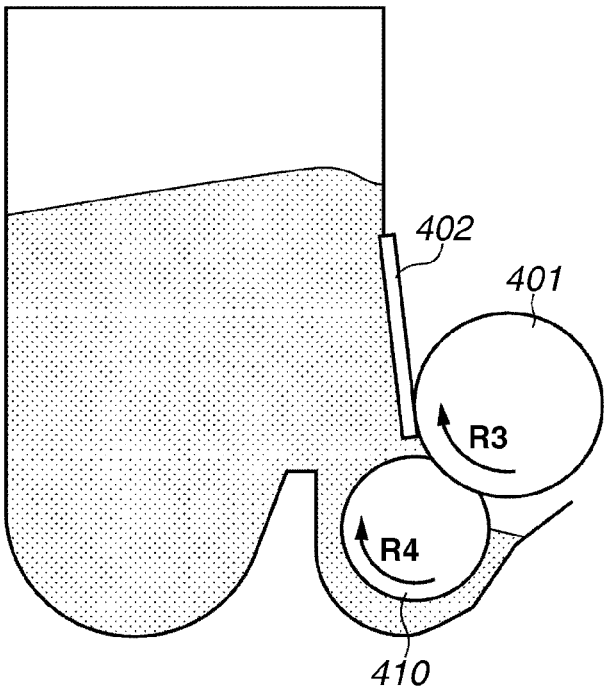
FIG. 6A schematically illustrates a configuration of developing devices DY, DM, and DC according to the second exemplary embodiment.
Figure 6B:
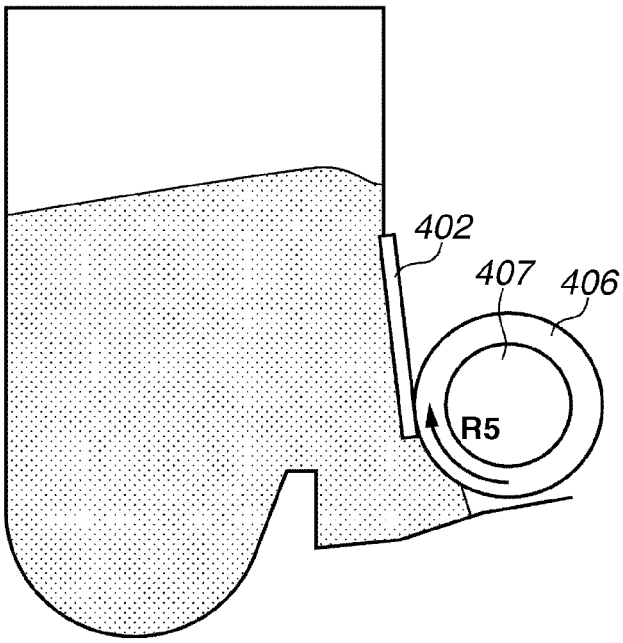
FIG. 6B schematically illustrates a configuration of a developing device DK.

FIG. 6A schematically illustrates a configuration of the developing devices DY, DM, and DC. FIG. 6B schematically illustrates a configuration of the developing device DK. In the second exemplary embodiment, the developing method differ between the developing devices DY, DM, and DC, and the developing device DK.

Each of the developing devices DY, DM, and DC includes the developing roller 401, an application roller 410, and a developing blade 402. A nonmagnetic one-component developer is used as toner. At the developing position, the developing roller 401 and the application roller 410 are driven by an external device to rotate in the directions indicated by the arrows R3 and R4, respectively. The developing devices DY, DM, and DC employ the contact developing method in which they contact the drum 100 to develop the electrostatic latent image during image forming operation.

The developing device DK includes the developing sleeve 406, a magnet roller 407 enclosed by the developing sleeve 406, and a developing blade 402. A magnetic one-component developer is used as toner. At the developing position, the developing sleeve 406 can be driven by an external device to rotate in the direction indicated by the arrow R5. The developing device DK employs the jumping developing method in which it is disposed to constantly maintain a predetermined gap between the developing device DK and the drum 100, a bias voltage composed of a direct current (DC) voltage and an alternating current (AC) voltage superimposed thereon is applied to the developing sleeve 406 to develop the electrostatic latent image.

In the second exemplary embodiment, only the black developing device DK employs the jumping developing method (advantageous to text and line printing) because many texts and lines are printed in mono color printing (mono color mode) using only black toner.

The cleaning device 600 includes a cleaning blade 601 and a waste toner container 602. The cleaning blade 601 is constantly in pressure contact with the drum 100 by a predetermined pressing force, physically scratches primary transfer residual toner remaining on the drum 100, and stores the removed toner in the waste toner container 602.

Each member constituting the image forming apparatus B wears down with repetitive operations of the image forming apparatus B. In particular, the drum 100 and toner are highly consumable members. The image forming apparatus B according to the second exemplary embodiment is a cartridge type image forming apparatus which allows a worn-out member to be easily detachable from the image forming apparatus B and replaceable with a new one. In the second exemplary embodiment, the developing devices DY, DM, DC, and DK are easily detachably attached to the image forming apparatus B to enable toner replacement. The drum 100, the charging roller 201, and the cleaning device 600 are integrated into a process cartridge BP to allow these members to be easily detached and attached to the image forming apparatus B.

The belt 502 is wound around a drive roller 506 and a counter roller 505 facing the drive roller 506. The drive roller 506 driven by a belt drive source (not illustrated) rotatably moves the belt 502 in the direction indicated by the arrow R1. A primary transfer roller 501 is in contact with the bottom surface of the drum 100 via the upper portion of the belt 502, and rotatably driven by the rotation of the belt 502. A contact nip portion between the drum 100 and the belt 502 is referred to as a primary transfer portion. A primary transfer bias power supply (not illustrated) can apply a primary transfer bias voltage to the primary transfer roller 501.

A cleaning roller 504 is provided at a portion of the belt 502 on the counter roller 505. The cleaning roller 504 performs preprocessing for causing the drum 100 to collect the secondary transfer residual toner remaining on the belt 502. A cleaning bias power supply (not illustrated) can apply a cleaning bias voltage to the cleaning roller 504.

The secondary transfer roller 503 is made of an elastic material. When in pressure contact with the belt 502, the secondary transfer roller 503 forms a nip portion (secondary transfer portion) between the belt 502 and secondary transfer roller 503, and rotates with the rotation of the belt 502 and the movement of the recording material 900 sent to the nip portion. A secondary transfer bias power supply (not illustrated) can apply a secondary transfer bias voltage to the secondary transfer roller 503.

During image forming operation, a contact separation member 507 controlled by the control unit 1000 separates the secondary transfer roller 503 from the belt 502. Then, the control unit 1000 controls the contact separation member 507 to contact the secondary transfer roller 503 to the belt 502 immediately before a full color toner image formed on the belt 502 reaches the position facing the secondary transfer roller 503.

A timing sensor 703 is disposed in the vicinity of the secondary transfer roller 503. A cassette 700 storing recording materials 900 is detachably attached to the image forming apparatus B below the secondary transfer roller 503 and the timing sensor 703. Plain paper, glossy paper, overhead projector sheets, etc. can be used as the recording materials 900.

The timing sensor 703 can detect that the recording material 900 has reached the position of the timing sensor 703. Based on the result of the detection, a drum life prediction device 707 (described below) can count the printed-sheet number.

The fixing device 800 includes a fixing roller 801 heated by a built-in halogen lamp heater (not illustrated), and a pressure roller 802 in pressure contact with the fixing roller 801.

<Image Forming Apparatus Operation: Full Color Mode>

First of all, the operations in the full color mode for forming a full color output image with reference to all of the developing devices DY, DM, DC, and DK, will be described.

Upon reception of a print request, the control unit 1000 starts rotating the drum 100. Then, the control unit 1000 controls the charging bias power supply 202 to apply a DC voltage to the charging roller 201 to charge the surface potential on the drum 100 to the dark potential VD=−500V. The image exposure device 300 outputs a laser beam L to scan the charged surface of the drum 100 for exposure. The laser beam L is modulated according to pixel signals based on image information decomposed into the four colors (yellow, magenta, cyan, and black), and forms respective electrostatic latent images in this order.

In the second exemplary embodiment, the control unit 1000 rotates the rotary drum 408 in the direction indicated by the arrow R6 to first dispose the yellow developing device DY at the predetermined developing position. When a yellow electrostatic latent image formed on the drum 100 by the image exposure device 300 passes through the developing position, a developing bias power supply (not illustrated) applies a developing bias voltage to the developing roller 401. Thus, a yellow toner image is formed on the drum 100.

The primary transfer roller 501 primarily transfers onto the belt 502 the yellow toner image visualized by the developing device DY. The cleaning device 600 removes the primary transfer residual toner remaining on the drum 100 without being primarily transferred onto the belt 502.

Upon completion of yellow toner image formation, the control unit 1000 starts a process of magenta toner image formation, i.e., the control unit 1000 rotates the rotary drum 408 again to dispose the magenta developing device DM at the developing position. Similar to the above-described yellow toner image formation, the control unit 1000 charges the drum 100 by the charging roller 201, forms a magenta electrostatic latent image by the image exposure device 300, and develops the magenta electrostatic latent image by the magenta developing device DM. Thus, a magenta toner image is formed on the drum 100. Then, the control unit 1000 transfers the magenta toner image on top of the yellow toner image already transferred onto the belt 502.

Similar to the magenta toner image formation, the control unit 1000 forms a cyan toner image on the drum 100 and transfers the cyan toner image on top of the toner image on the belt 502. Similarly, the control unit 1000 forms a black toner image and transfers the black toner image on top of the toner image on the belt 502. Thus, a full color toner image is formed on the belt 502.

The secondary transfer roller 503 collectively transfers the full color toner image formed on the belt 502 onto the recording material 900. The recording material 900 with the full color toner image transferred thereon is conveyed to the fixing device 800, subjected to heat and pressure for image fixation, and then discharged onto a discharge tray 705 as a full color image formed product.

The control unit 1000 sequentially performs the image forming operation according to the second exemplary embodiment in order of yellow, magenta, cyan, and black. After completion of the image forming operation by the black developing device DK, the control unit 1000 stops the black developing device DK at the developing position.

After completion of primary transfer of the black toner image, the drum 100 collects the secondary transfer residual toner remaining on the belt 502. After completion of collection of the secondary transfer residual toner, the control unit 1000 turns OFF all of the bias voltages. Then, the control unit 1000 stops the rotation of the drum 100, and the image forming apparatus B prepares for the next print request. In other words, the image forming apparatus B is held in the standby state until the following print request is received.

This completes a series of image forming operations in the full color modes. When forming images on a plurality of sheets, the control unit 1000 repeats the above-described sequence.

<Image Forming Apparatus Operation: Mono Color Mode>

The operation in the mono color mode for forming only black output images by using only the black developing device DK out of the developing devices DY, DM, DC, and DK, will be described.

Upon reception of a print request, the control unit 1000 starts rotating the drum 100. Then, the control unit 1000 controls the charging bias power supply 202 to apply a DC voltage to the charging roller 201 to charge the surface potential on the drum 100 to the dark potential VD=−500V. The image exposure device 300 outputs a laser beam L to scan the charged surface of the drum 100 for exposure. The laser beam L is modulated corresponding to a pixel signal based on image information for black, and forms an electrostatic latent image.

In the mono color mode, the control unit 1000 fixes the developing device DK at the developing position without rotating the rotary drum 408. When the black electrostatic latent image formed on the drum 100 by the image exposure device 300 passes through the developing position, the developing bias power supply (not illustrated) applies the developing bias voltage to the developing sleeve 406. Thus, a black toner image is formed on the drum 100.

The primary transfer roller 501 primarily transfers onto the belt 502 the black toner image visualized by the developing device DK. The cleaning device 600 removes the primary transfer residual toner remaining on the drum 100 without being transferred onto the belt 502.

The secondary transfer roller 503 transfers onto the recording material 900 the black toner image formed through the above-described image forming operation. The recording material 900 with the black toner image transferred thereon is conveyed to the fixing device 800, subjected to heat and pressure for image fixation, and then discharged onto the discharge tray 705 as a mono color image formed product.

After completion of the image forming operation only by the black developing device DK, the control unit 1000 stops the black developing device DK at the developing position. After completion of primary transfer of the black toner image, the drum 100 collects the secondary transfer residual toner remaining on the belt 502. After completion of collection of the secondary transfer residual toner, the control unit 1000 turns OFF all of the bias voltages. Then, the control unit 1000 stops the rotation of the drum 100, and the image forming apparatus B prepares for the next print request.

This completes the image forming operation in the mono color mode. When forming images on a plurality of sheets, the control unit 1000 repeats the above-described sequence.

<Longitudinal Configuration of Developing Device>

The longitudinal positional relations in the developing devices DY, DM, and DC according to the second exemplary embodiment are similar to the longitudinal positional relations in the developing devices 400 according to the first exemplary embodiment illustrated in FIG. 2A, and detailed description thereof will be omitted.

Figure 2B:
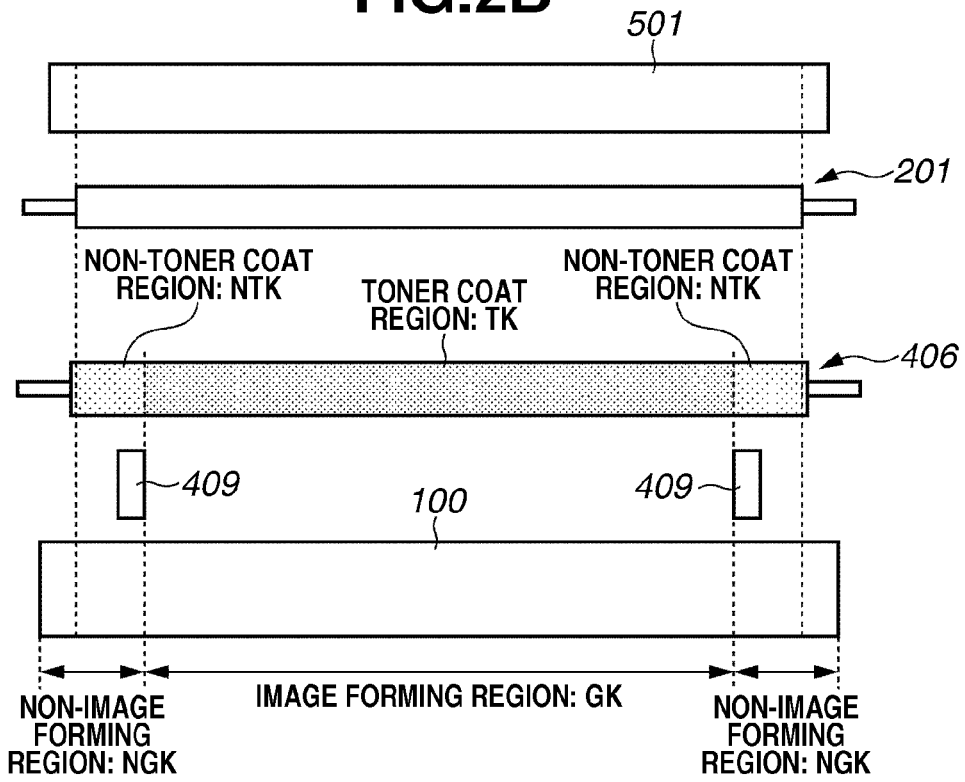
FIG. 2B schematically illustrates a longitudinal configuration of a photosensitive drum and a process unit acting thereon according to a second exemplary embodiment.

FIG. 2B illustrates the longitudinal positional relations between the drum 100, the charging roller 201, the developing sleeve 406, and the cleaning blade 601 in the developing device DK according to the second exemplary embodiment. As a seal member for restricting toner leak from the developing device DK, a magnetic seal 409 composed of a permanent magnet is disposed at both ends of the developing sleeve 406 in the developing device DK. The magnetic force of the magnetic seals 409 restricts toner leak from the developing device DK at both ends of the developing sleeve 406.

The region on the inner side of the magnetic seals 409 at both ends of the developing sleeve 406 is a toner coat region TK which is coated by toner. In the present exemplary embodiment, the width of the toner coat region TK is 216 mm. The regions on the outer side of the toner coat region TK are non-toner coat regions NTK which are not coated by toner.

The region on the surface of the drum 100 corresponding to the toner coat region TK of the developing sleeve 406 is an image forming region GK. The regions on the outer side of the image forming region GK are non-image forming regions NGK.

The image forming region GR of the drum 100 when the drum 100 faces each of the developing devices DY, DM, and DC is identical to the image forming region GK of the drum 100 when the drum 100 faces the developing device DK. Similarly, the non-image forming regions NGR are identical to the non-image forming regions NGK. In the following descriptions, the image forming region GK and the image forming regions NGK are unified into the image forming region GR and the non-image forming regions NGR, respectively.

In the developing device DK, the developing sleeve 406 is not in contact with the drum 100. Therefore, in the non-toner coat regions NTK at both longitudinal ends of the drum 100, the situation of the developing device DK differs from the situations of the developing devices DY, DM, and DC. That is, when the developing device DK is disposed at the developing position, the CT layer abrasion promoted at both longitudinal ends of the drum 100 does not occur.

<Remaining CT Film Thickness Prediction for Photosensitive Drum 100>

The details of the remaining CT film thickness prediction for the drum 100 in which the CT film thickness of the drum 100 of the image forming apparatus B is predicted, will be described. The CT layer of the drum 100 wears down with operating time of the image forming apparatus B. In the following descriptions, the remaining CT film thickness prediction for the drum 100 refers to processing for predicting the amount of CT layer abrasion in the image forming region GR of the drum 100 during image forming operation, and calculating the remaining CT film thickness of the drum 100.

The CT layer abrasion amount of the drum 100 depends on how each of elements, such as the charging roller 201, the developing devices DY, DM, and DC, and DK, acts on the drum 100 during image forming operation.

In the second exemplary embodiment, the CT layer abrasion amount of the drum 100 depends on the following conditions:

When only the charging bias voltage is applied, and the black developing device DK is performing the image forming operation (condition 1), When the charging bias voltage is applied, and the developing roller 401 is in contact with the drum 100 in the developing devices DY, DM, and DC (condition 3), When the black developing device DK performs the image forming operation, the developing sleeve 406 is not in contact with the drum 100, and the developing bias voltage at this timing does not affect the CT layer abrasion of the drum 100. Thus, we set the same condition as the condition when only the charging bias voltage is applied.

The above-described conditions 1 and 3 are identical to conditions 1 and 3 according to the first exemplary embodiment. The method for calculating the remaining CT film thickness Nct of the drum 100 is also identical to that according to the first exemplary embodiment, detailed description thereof will be omitted.

<Life Prediction for Photosensitive Drum 100>

Next, the details of the drum life prediction for predicting the life of the drum 100, which is a feature of an embodiment of the present invention, will be described.

In the drum life prediction according to the present exemplar embodiment, the control unit 1000 presets the drum life threshold value in the image forming region GR of the drum 100 when each of the plurality of image formation execution modes (full color and mono color modes in the present exemplary embodiment) is independently used. In the image forming apparatus B, the drum life threshold value is set for all of the image formation execution modes each having a different CT layer abrasion in the non-image forming regions NGR and a different CT layer abrasion in the image forming region GR of the drum 100.

Then, the control unit 1000 calculates how long each color mode has been used with operating time of the image forming apparatus B, i.e., the "usage rate" of each color mode. Then, based on the calculated usage rate and the drum life threshold value preset for each color mode, the control unit 1000 calculates "the photosensitive drum life threshold value according to the usage rate". Then, the control unit 1000 compares the "photosensitive drum life threshold value according to the usage rate" with the above-described remaining CT film thickness Nct of the drum 100 to determine whether the drum 100 has reached the end of the life.

The drum life prediction according to the second exemplary embodiment can be applied when the drum life threshold value in the image forming region GR differ in each color mode of the image forming apparatus B. In the second exemplary embodiment, the drum life threshold value differs between a case where the full color mode is used and a case where the mono color mode is used.

Here, the reason why the CT film thickness in the image forming region GR used as the drum life threshold value differs between the full color and mono color modes, will be described.

In the full color mode, when each of the developing devices DY, DM, and DC employing the contact developing method is disposed at the developing position, the developing roller 401 and the drum 100 are constantly in contact with each other. Therefore, at this timing, the CT layer abrasion is promoted at both longitudinal ends of the drum 100, and accordingly the CT layer abrasion at both longitudinal ends of the drum 100 increases.

Therefore, when printing is performed only in the full color mode, the time immediately before the CT layer abrasion at both longitudinal ends of the drum 100 reaches the resistive layer needs to be set as the life of the entire drum 100, to prevent the leak development at both longitudinal ends of the drum 100. Therefore, the control unit 1000 sets the film thickness of the CT layer in the image forming region GR of the drum 100 at this timing as the drum life threshold value.

We confirmed in an experiment using the image forming apparatus B that the CT film thickness in the image forming region GR of the drum 100 immediately before the CT layer abrasion at both longitudinal ends of the drum 100 reached the resistive layer, i.e., immediately before the CT film thickness at both longitudinal ends of the drum 100 becomes 0 μm, when only the full color mode was used. The CT film thickness in the image forming region GR at this timing was 8.49 μm. Therefore, in the second exemplary embodiment, we set the drum life threshold value when only the full color mode is used (the full color life threshold value Jfc) to 8.49 μm.

In the mono color mode, only the developing device DK employing the jumping developing method performs the image forming operation. Accordingly, since the developing sleeve 406 is not in contact with the drum 100, the promoted CT layer abrasion at both longitudinal ends of the drum 100, as seen in the full color mode, does not occur.

Therefore, when printing is performed only in the mono color mode, the CT layer film thickness immediately before an image failure occurs in the image forming region GR of the drum 100 as the life of the drum 100 without being affected by the CT layer abrasion at both longitudinal ends of the drum 100. Therefore, similar to the first exemplary embodiment, we set the drum life threshold value when only the mono color mode is used (the mono color life threshold value Jmc) to 7 μm.

The details of the reason why a drum life threshold value according to the usage rate of each of a plurality of image formation execution modes (in the present exemplary embodiment, the full color and mono color modes), which is a feature of an embodiment of the present invention, will be described.

When printing is performed only in the full color mode, the CT layer in the image forming region GR of the drum 100 can be used up to 8.49 μm because of the effect of the CT layer abrasion at both longitudinal ends of the drum 100, as described above. That is, the remaining CT film thickness in the image forming region GR is 8.49 μm. However, when printing only in the full color mode is changed to printing only in the mono color mode before the 8.49-μm remaining film thickness is reached, there is almost no effect of the CT layer abrasion at both longitudinal ends of the drum 100. Therefore, there is no reason why the 8.49-μm remaining film thickness is set as the drum life threshold value.

This means that the usable amount of the CT layer in the image forming region GR of the drum 100 increases with increasing operating time in the mono color mode. However, for example, in a case where only one drum life threshold value (8.49 μm in the full color mode) was used in both color modes, 8.49 μm was used as the life of the drum 100 even with a long operating time in the mono color mode. This means that, although the CT film thickness in the image forming region GR of the drum 100 is below 8.49 μm (there remains a usable CT film thickness), the drum 100 has reached the end of the life with the usable CT film thickness unused.

According to the present exemplary embodiment, there is almost no effect of the CT layer abrasion at both longitudinal ends of the drum 100 when only the mono color mode is used. Therefore, the control unit 1000 performs control, by shifting the remaining CT film thickness in the image forming region GR from 8.49 μm close to 7 μm, to decrease the remaining CT film thickness with increasing operating time in the mono color mode. This processing enables outputting a greater number of print images in the mono color mode.

The details of the drum life prediction when the image forming apparatus B is operated by using the two color modes in combination, i.e., a feature of an embodiment of the present invention, will be described. In this case, the control unit 1000 calculates the combined color life threshold value E (the drum life threshold value according to the print rate) by using the full color life threshold value Jfc and the mono color life threshold value Jmc (the drum life threshold value when only each of the full color and mono color modes is used, respectively) and the print rate of the mono color mode. The method for calculating the combined color life threshold value E according to the second exemplary embodiment is identical to that according to the first exemplary embodiment, and detailed description thereof will be omitted.

Figure 7A:
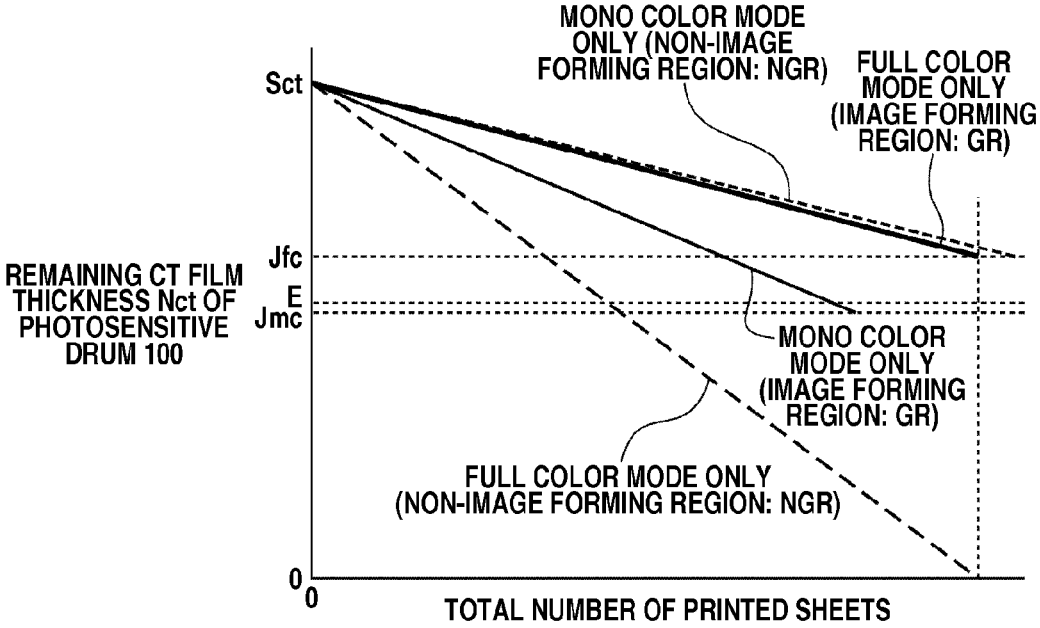
FIG. 7A is a graph illustrating transitions of the remaining CT film thickness Nct in the image forming region GR and in the non-image forming regions NGR of the photosensitive drum 100 with increasing printed-sheet number when only the full color mode is used and when only the mono color mode is used according to the second exemplary embodiment.

FIG. 7A illustrates transitions of the remaining CT film thickness Nct in the image forming region GR and in the non-image forming regions NGR of the drum 100 with increasing printed-sheet number when the image forming apparatus B is operated only in the full color mode and only in the mono color mode.

The thick line indicates the transition of the remaining CT film thickness Nct in the image forming region GR of the drum 100 with increasing printed-sheet number when only the full color mode is used. The thick dotted line indicates the transition of the CT film thickness in the non-image forming regions NGR of the drum 100 when only the full color mode is used. The thin line indicates the transition of the remaining CT film thickness Nct in the image forming region GK of the drum 100 when only the mono color mode is used. The thin dotted line indicates the transition of the CT film thickness in the non-image forming regions NGR of the drum 100 when only the mono color mode is used.

Figure 7B:
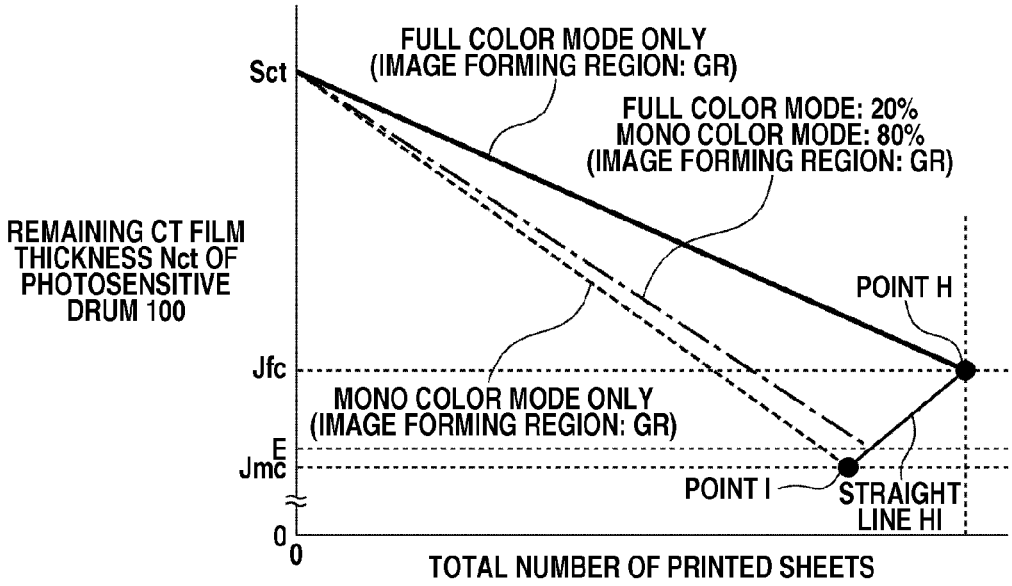
FIG. 7B is a graph illustrating transitions of the remaining CT film thickness Nct in the image forming region GR of the photosensitive drum 100 with increasing printed-sheet number when only the full color mode is used, when only the mono color mode is used, and when the two color modes are used in combination according to the second exemplary embodiment.

FIG. 7B illustrates transitions of the remaining CT film thickness Nct in the image forming region GR of the photosensitive drum 100 with increasing printed-sheet number when the image forming apparatus B is operated only in the full color mode and only in the mono color mode. FIG. 7B further illustrates a transition of the remaining CT film thickness Nct in the image forming region GR of the photosensitive drum 100 with increasing printed-sheet number when the image forming apparatus B is operated by using the two color modes in combination (20% full color mode and 80% mono color mode).

The thick line indicates the transition of the remaining CT film thickness Nct in the image forming region GR of the drum 100 when printing is performed only in the full color mode. The thin line indicates the transition of the remaining CT film thickness Nct in the image forming region GR of the drum 100 when printing is performed only in the mono color mode. The chain line indicates the transition of the remaining CT film thickness Nct in the image forming region GR of the drum 100 with increasing printed-sheet number when printing is performed by using the two color modes in combination (20% full color mode and 80% mono color mode).

Referring to FIG. 7B, the transitions of the remaining CT film thickness Nct with increasing printed-sheet number when only the full color mode is used and when only the mono color mode is used are similar to the transitions illustrated in FIG. 7A.

FIGS. 7A and 7B illustrate what is called 2-sheet intermittent printing in which the image forming operation for continuous two sheets is repeated by using the image forming apparatus B. The horizontal axis is assigned the total printed-sheet number of the two color modes, and the vertical axis is assigned the remaining CT film thickness Nct of the drum 100.

The full color life threshold value Jfc (the drum life threshold value when only the full color mode is used) is 8.49 μm. The mono color life threshold value Jmc (the drum life threshold value when only the mono color mode is used) is 7 μm. The combined color life threshold value E (the drum life threshold value according to the usage rate of the mono color mode) is $8.49-\{0.8\times(8.49-7)\}=7.298$ μm according to the second exemplary embodiment.

As illustrated in FIG. 7A, when printing is performed only in the full color mode, the following result was acquired. Specifically, when the CT film thickness reached 0 μm in the non-image forming regions NGR, i.e., at both longitudinal ends of the drum 100, the remaining CT film thickness Nct in the image forming region GR reached the full color life threshold value Jfc=8.49 μm.

Further, when printing was performed only in the mono color mode, the CT film thickness in the non-image forming regions NGR did not reach 0 μm even when the remaining CT film thickness Nct in the image forming region GR reached the mono color life threshold value Jmc=7 μm.

The end of the drum life was notified when the remaining CT film thickness Nct reached the full color life threshold value Jfc and the mono color life threshold value Jmc in the full color and mono color modes, respectively.

As illustrated in FIG. 7B, when printing was performed only in the full color mode, the remaining CT film thickness Nct reached the full color life threshold value Jfc=8.49 μm. Further, when printing was performed only in the mono color mode, the remaining CT film thickness Nct reached the mono color life threshold value Jmc=7 μm.

Further, when printing was performed by using the two color modes in combination (20% full color mode and 80% mono color mode), the remaining CT film thickness Nct reached the combined color life threshold value E=7.298 μm calculated according to the print rates of the two color modes.

At this timing, the life of the drum 100 was notified on the operation panel 706. In any of these cases, we were able to acquire favorable images without leak at both longitudinal ends of the drum 100 and an image failure due to fogging until the remaining CT film thickness Nct reached the drum life threshold values Jfc, Jmc, and E.

Referring to FIG. 7B, the transitional line of the remaining CT film thickness Nct in the image forming region GR of the drum 100 when only the full color mode is used intersects with the full color life threshold value Jfc (the drum life threshold value when only the full color mode is used) at an intersecting point H. The transitional line of the remaining CT film thickness Nct in the image forming region GR of the drum 100 when only the mono color mode is used intersects with the mono color life threshold value Jmc (the drum life threshold value when only the mono color mode is used) at an intersecting point I.

As described above, the combined color life threshold value E is calculated according to the print rates of the two color modes. Therefore, when printing is performed by using the two color modes in combination, the combined color life threshold value E (the drum life threshold value according to the usage rates of the two color modes) is set on a straight line HI connecting the above-described points H and I. Therefore, also in the second exemplary embodiment, when printing is performed by using the two color modes in combination, the following result was acquired. Specifically, the drum 100 reaches the end of the life on the straight line HI without leak at both longitudinal ends (in the non-image forming regions NGR) of the drum 100 and fogging due to dark attenuation in the image forming region GR thereof.

<Photosensitive Drum Life Prediction Device>

Similar to the control unit 1000 of the image forming apparatus A according to the first exemplary embodiment, the control unit 1000 of the image forming apparatus B according to the second exemplary embodiment includes the drum life prediction device (drum life prediction function unit) 707. The drum life prediction device 707 includes a remaining CT film thickness prediction device (remaining CT film thickness prediction function unit) 708 for predicting the remaining CT film thickness Nct of the drum 100, and a life determination device (life determination function unit) 709 for determining whether the drum 100 has reached the end of the life.

The cartridge BP includes a memory 710. Information can be written and read to and from the memory 710 through communication with the control unit 1000. In other words, the control unit 1000 is provided with functions of writing and reading information to and from the memory 710.

The memory 710 stores information about the drum 100. The information about the drum 100 includes the drum life threshold values (Jfc and Jmc), the abrasion coefficients (cc1 and cd1), the printed-sheet numbers (Pfc and Pmc), the remaining CT film thickness Nct of the drum 100, and the start CT film thickness Sct of the drum 100.

The printed-sheet numbers (Pfc and Pmc) are "0" when the process cartridge BP is started being used, and successively updated with operating time of the image forming apparatus B. The remaining CT film thickness Nct of the drum 100 is "13 μm" when the cartridge BP is started being used, and successively updated with operating time of the image forming apparatus B.

The drum life prediction device 707 according to the second exemplary embodiment is identical to that according to the first exemplary embodiment, and detailed description thereof will be omitted.

<Photosensitive Drum Life Determination Sequence>

The sequence chart for determining whether the drum 100 has reached the end of the life according to the second exemplary embodiment is identical to that according to the first exemplary embodiment (FIG. 4), and detailed description thereof will be omitted. By executing also in the second exemplary embodiment similar processing of the flow chart to that according to the first exemplary embodiment, the drum 100 can be used up to a more appropriate remaining CT film thickness even when the full color and mono color modes are used in combination.

Thus, it is possible to prevent the drum 100 from being determined to have reached the end of the life although image formation is still possible, and prevent the drum 100 from being continuously used although image formation is no longer possible.

In the second exemplary embodiment, the control unit 1000 acquired the combined color life threshold value E by calculating the print rate of the mono color mode. However, the combined color life threshold value E can also be acquired by calculating the print rate of the full color mode.

In the second exemplary embodiment, the control unit 1000 acquired the usage rate of the mono color mode by calculating the print rate of the mono color mode, PHmc, i.e., the ratio of the number of sheets printed in the mono color mode to the total printed-sheet number. However, as described in the first exemplary embodiment, the usage rate of each color mode may be acquired based not on the print rate but on the time duration during which the developing roller 401 is in contact with the drum 100 in image forming operation.

The image forming apparatus B according to the second exemplary embodiment is described to have the full color and mono color modes as a plurality of image formation execution modes having different amounts of abrasion between the image forming region of the drum 100 and the non-image forming regions of the drum 100. However, as described in the first exemplary embodiment, the plurality of image formation execution modes is not limited to the two color modes.

An embodiment of the present invention is also applicable not only to a full color image forming apparatus but also to a mono color image forming apparatus which performs mono color image formation.

In short, an embodiment of the present invention is applicable to a case where, when the image forming apparatus is operated in a plurality of image formation execution modes in combination, the life threshold value of the drum 100 differs for each image formation execution mode.

The intermediate transfer belt 502 in the image forming apparatus A according to the first exemplary embodiment and the image forming apparatus B according to the second exemplary embodiment is replaced with the transfer belt 502 (a recording material conveyance member for supporting and conveying a recording material 900). The toner image formed on the drum 100 can also be directly transferred onto a recording material 900 supported and conveyed by the transfer belt. An embodiment of the present invention is also applicable to a thus-configured image forming apparatus, and similar effects can be acquired.

According to an embodiment of the present invention, it is possible to provide an image forming apparatus capable of determining the life of an image bearing member based on a more suitable photosensitive layer film thickness in an image forming region of the image bearing member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-154478 filed Jul. 10, 2012, which is hereby incorporated by reference herein in its entirety.

What is claimed is:

1. An image forming apparatus comprising:

a rotatable image bearing member;

a charging unit configured to charge a surface of the image bearing member;

an electrostatic latent image forming unit configured to perform exposure of a charged surface of the image bearing member to form an electrostatic latent image on the image bearing member;

a developing unit configured to develop the electrostatic latent image into a visible image by using a developer bearing member; and a cleaning unit disposed in contact with the image bearing member, and configured to clean the developer remaining on the surface of the image bearing member, wherein the image forming apparatus has first and second image formation execution modes, wherein the first mode is performed by contacting the image bearing member and the developer bearing member and the second mode is performed by not contacting the image bearing member and the developer bearing member, and wherein the image forming apparatus uses a variable threshold, for notifying the life of the image bearing member, the variable threshold being based on (i) life thresholds of the image bearing member for the first and second modes and (ii) a usage rate of the first and second modes.

2. The image forming apparatus according to claim 1, wherein the developer bearing member is capable of contacting the image bearing member, and has a developer bearing region for bearing the developer over the same longitudinal range as the image forming region of the image bearing member in the axial direction, and developer non-bearing regions not bearing the developer on the outer side of both ends of the developer bearing region.

3. The image forming apparatus according to claim 1, wherein the usage rate of each of the first and second image formation execution modes is the image-formed sheet number rate of each of the plurality of image formation execution modes with respect to the total image-formed sheet number.

4. The image forming apparatus according to claim 1, wherein the usage rate of each of the first and second image formation execution modes is the rate of rotation time duration during which the developer bearing member is in contact with the image bearing member in each of the first and second image formation execution modes with respect to the total rotation time duration of the developer bearing member.

5. The image forming apparatus according to claim 1, further comprising a rotary developing unit installation unit capable of installing a plurality of developing units, and configured to be rotated to enable the developing units to sequentially develop respective images on the image bearing member, wherein the image forming apparatus has a plurality of image formation execution modes, and wherein the plurality of image formation execution modes includes at least an image formation execution mode in which the developer bearing member of each developing unit contacts the image bearing member, and an image formation execution mode in which the developer bearing member of each developing unit does not contact the image bearing member.

6. The image forming apparatus according to claim 1, wherein the first mode has a different amount of abrasion in a non-image formation region of the image bearing member, from the second mode.

7. The image forming apparatus according to claim 1, wherein each of the life thresholds is based on a thickness of the image bearing member.

8. The image forming apparatus according to claim 1, further comprising a plurality of cartridges each comprising:

a rotatable image bearing member; and a developing unit configured to develop the electrostatic latent image into a visible image by using a developer bearing member.

9. The image forming apparatus according to claim 8, wherein each of the plurality of cartridges further comprises:

a charging unit disposed in contact with the image bearing member, and configured to charge a surface of the image bearing member; and a cleaning unit disposed in contact with the image bearing member, and configured to clean the developer remaining on the surface of the image bearing member.

10. The image forming apparatus according to claim 8, wherein a first cartridge among the plurality of cartridges is a black-color cartridge and the second mode is not executed in the black-color cartridge.

11. The image forming apparatus according to claim 1, wherein the image bearing member includes a photosensitive layer made of an organic material.

12. The image forming apparatus according to claim 1, further comprising an operating state prediction unit configured to predict an operating state of the image bearing member.

13. The image forming apparatus according to claim 1, wherein the charging unit is disposed in contact with the image bearing member.

14. The image forming apparatus according to claim 1, wherein a thickness of the image bearing member when the image forming apparatus is in the first image formation execution mode is thinner than the thickness of the image bearing member when the image forming apparatus is in the second image formation execution mode.

* * * * *